US009517624B2

(12) United States Patent
Yoda

(10) Patent No.: US 9,517,624 B2
(45) Date of Patent: Dec. 13, 2016

(54) WIRING MOUNTING STRUCTURE AND METHOD OF MANUFACTURING THE SAME, AND LIQUID EJECTING HEAD AND LIQUID EJECTING APPARATUS

(71) Applicant: Seiko Epson Corporation, Tokyo (JP)

(72) Inventor: Tsuyoshi Yoda, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/620,620

(22) Filed: Feb. 12, 2015

(65) Prior Publication Data

US 2015/0231882 A1 Aug. 20, 2015

(30) Foreign Application Priority Data

Feb. 18, 2014 (JP) ..... 2014-028255

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2002/14491* (2013.01)

(58) Field of Classification Search
CPC ..... B41J 2/1623; B41J 2/1433; B41J 2002/14491; B32B 37/24
(Continued)

(56) References Cited

U.S. PATENT DOCUMENTS

2002/0008741 A1* 1/2002 Temple ..... B41J 2/14209 347/68
2002/0135643 A1* 9/2002 Sarojiniamma ..... B41J 2/14209 347/68
(Continued)

FOREIGN PATENT DOCUMENTS

JP 2007-066965 A 3/2007
JP 2007066965 A * 3/2007
JP 2007-290232 A 11/2007

*Primary Examiner* — Matthew Luu
*Assistant Examiner* — Patrick King
(74) *Attorney, Agent, or Firm* — Harness, Dickey & Pierce, P.L.C.

(57) ABSTRACT

A wiring mounting structure includes: a first base that has a first main surface, a second main surface that is an under-surface opposite to the first main surface, and an inclined surface that is formed between the first main surface and the second main surface to have an angle as a reference angle with the second main surface, which is less than 90 degrees; a second base that has a third main surface which is joined to the second main surface of the first base; an adhesive which is disposed between the second main surface of the first base and the third main surface of the second base from an end portion of the inclined surface of the first base to an exposed region on the third main surface of the second base and by which the first base and the second base are joined; and a connection wiring that is provided to be continuous on from the inclined surface through the front surface of the adhesive to the third main surface of the second base. The front surface of the adhesive is provided to be continuous to the inclined surface and thus an angle formed between the front surface of the adhesive in a portion in which the adhesive is provided to be continuous to the inclined surface and the third main surface on which the adhesive is provided is less than the reference.

2 Claims, 14 Drawing Sheets

(58) Field of Classification Search
USPC ..... 347/50
See application file for complete search history.

(56) References Cited

U.S. PATENT DOCUMENTS

| | | | | |
|---|---|---|---|---|
| 2006/0164468 | A1* | 7/2006 | Yoda | B41J 2/14233 347/71 |
| 2006/0250456 | A1* | 11/2006 | Matsuzawa | B41J 2/14233 347/68 |
| 2009/0231396 | A1* | 9/2009 | Yazaki | B41J 2/055 347/71 |
| 2010/0079557 | A1* | 4/2010 | Okubo | B41J 2/14233 347/71 |
| 2010/0238237 | A1* | 9/2010 | Seki | B41J 2/1433 347/71 |
| 2011/0115854 | A1* | 5/2011 | Sharan | B41J 2/14129 347/56 |
| 2012/0229576 | A1* | 9/2012 | Ohsawa | B41J 2/1609 347/68 |
| 2013/0037829 | A1* | 2/2013 | Chang | H01L 27/124 257/88 |

* cited by examiner

WIRING MOUNTING STRUCTURE AND METHOD OF MANUFACTURING THE SAME, AND LIQUID EJECTING HEAD AND LIQUID EJECTING APPARATUS

BACKGROUND

1. Technical Field

The present invention relates to a wiring mounting structure that includes a connection wiring and a method of manufacturing the wiring mounting structure, and a liquid ejecting head and a liquid ejecting apparatus.

2. Related Art

A liquid ejecting head that ejects a droplet includes a flow path formation substrate (second base) in which a pressure generating chamber communicates with a nozzle opening is formed, a piezoelectric actuator provided on one surface side of the flow path formation substrate, and a protection substrate (first base) that is joined to the flow path formation substrate on a side of the piezoelectric actuator. The liquid ejecting head causes the piezoelectric actuator to produce a pressure change in a liquid in the pressure generating chamber and thereby ejects the liquid from a nozzle opening.

In such an ink jet-type recording head, a configuration has been proposed, in which a drive circuit (semiconductor element) is provided on a surface opposite to a surface of the protection substrate to which the flow path formation substrate is joined, an opening is formed on the protection substrate, a wiring connected to the piezoelectric actuator in the opening is exposed, and the drive circuit and the piezoelectric actuator are connected electrically to each other through the connection wiring provided on a side wall of the opening of the protection substrate (for example, see JP-A-2007-290232).

In such an ink jet-type recording head, the flow path formation substrate and the protection substrate are joined to each other by an adhesive, then the connection wiring is formed to be disposed on the side wall of the opening, a front surface of the adhesive and a front surface of the flow path formation substrate by film deposition, and then patterning is performed on the connection wiring into a predetermined shape by a lithography process or the like.

In addition, there has been proposed a configuration in which an insulation member that covers the side wall and the front surface of the flow path formation substrate is provided such that the connection wiring is formed on the insulation member (for example, see JP-A-2007-66965).

However, in the case where the flow path formation substrate and the protection substrate are joined to each other and then the connection wiring is formed by the film deposition and the lithography process, a problem arises in that resists for patterning the connection wiring on a corner that is formed between the side wall and the front surface of the flow path formation substrate are accumulated, thus it is not possible to form the resists to have the same thickness, and overexposure is needed, which causes the patterned connection wiring to have a non-uniform width.

In addition, as in JP-A-2007-66965, in the case where the insulation member is provided to cover the corner formed by the side wall and the front surface of the flow path formation substrate, a problem arises in that a process of providing the insulation member is needed and thus a manufacturing operation becomes complicated and cost of manufacturing is increased.

Such problems arise in a wiring mounting structure that is used not only in the liquid ejecting head, but also in another device.

SUMMARY

An advantage of some aspects of the invention is to provide a wiring mounting structure and a method of manufacturing the wiring mounting structure, and a liquid ejecting head and a liquid ejecting apparatus in which a connection wiring is formed with high accuracy, thus it is possible to suppress an occurrence of failure such as a disconnection or a short circuit, and cost is decreased.

According to an aspect of the invention, there is provided a wiring mounting structure including: a first base that has a first main surface, a second main surface that is an undersurface opposite to the first main surface, and an inclined surface that is formed between the first main surface and the second main surface to have an angle as a reference angle with the second main surface, which is less than 90 degrees; a second base that has a third main surface which is joined to the second main surface of the first base; an adhesive which is disposed between the second main surface of the first base and the third main surface of the second base from an end portion of the inclined surface of the first base to an exposed region on the third main surface of the second base and by which the first base and the second base are joined; and a connection wiring that is provided to be continuous from the inclined surface through the front surface of the adhesive to the third main surface of the second base. The front surface of the adhesive is provided to be continuous to the inclined surface and thus an angle formed between the front surface of the adhesive in a portion in which the adhesive is provided to be continuous to the inclined surface and the third main surface on which the adhesive is provided is less than the reference angle.

In this case, the adhesive by which the first base and the second base are bonded is disposed from the inclined surface to the exposed region from the third main surface of the second base and the angle formed between the front surface of the adhesive and the third main surface is less than the reference angle. Thus, it is possible to suppress variations of a thickness of the connection wiring that is formed from the adhesive to the third main surface. In addition, the connection wiring that is formed from the adhesive to the third main surface is prevented from forming a corner with an angle equal to or greater than the reference angle and thus it is possible to suppress an occurrence of breaking due to a stress concentration on the corner. In addition, since the adhesive is used, it is possible to simplify manufacturing processes and thus to decrease cost compared to using a filler or the like other than the adhesive.

In the wiring mounting structure, it is preferable that the adhesive provided to be continuous to the inclined surface also be provided on the inclined surface. In this case, it is possible to easily provide the front surface of the adhesive to be continuous to the inclined surface.

In the wiring mounting structure, it is preferable that, with respect to a straight line that connects a contact point between the front surface and the third main surface and a contact point between the front surface of the adhesive and the inclined surface, the front surface of the adhesive be provided on the side of the third main surface in which the straight line is included. In this case, it is possible to reliably form the angle with the third main surface in an entire region of the front surface of the adhesive to be less than the reference angle. In addition, since the front surface of the adhesive has a so-called concave shape, attachment of the connection wiring formed on the front surface of the adhesive is improved and it is possible to suppress variations of a thickness of the connection wiring.

According to another aspect of the invention, there is provided a method of manufacturing a wiring mounting structure. The wiring mounting structure includes: a first base that has a first main surface, a second main surface that is an undersurface opposite to the first main surface, and an inclined surface that is formed between the first main surface and the second main surface to have an angle as a reference angle with the second main surface, which is less than 90 degrees; a second base that has a third main surface which is joined to the second main surface of the first base; an adhesive which is disposed between the second main surface of the first base and the third main surface of the second base from an end portion of the inclined surface of the first base to an exposed region on the third main surface of the second base and by which the first base and the second base are joined; and a connection wiring that is provided to be continuous from the inclined surface through the front surface of the adhesive to the third main surface of the second base. The method of manufacturing a wiring mounting structure includes: performing a hydrophobic treatment on at least the inclined surface of the first base and on the third main surface; bonding the first base and the second base by the adhesive, providing the front surface of the adhesive to be continuous to the inclined surface, and forming an angle, between the front surface of the adhesive in a portion where the front surface of the adhesive is provided to be continuous to the inclined surface and the third main surface on which the adhesive is provided, to be less than the reference angle; and performing film deposition and patterning of the connection wiring from the inclined surface of the first base through the front surface of the adhesive to the third main surface.

In this case, the adhesive by which the first base and the second base are bonded is disposed from the inclined surface to the exposed region on the third main surface of the second base and the angle formed between the front surface of the adhesive and the third main surface is less than the reference angle. Thus, it is possible to suppress variations of a thickness of the connection wiring that is formed from the adhesive to the third main surface. In addition, the connection wiring that is formed from the adhesive to the third main surface is prevented from forming a corner with an angle equal to or greater than the reference angle and thus it is possible to suppress an occurrence of breaking due to a stress concentration on the corner. In addition, since the adhesive is used, it is possible to simplify manufacturing processes and thus to decrease cost compared to using a filler or the like other than the adhesive.

In the method of manufacturing a wiring mounting structure, it is preferable that the hydrophobic treatment be a coupling treatment in which a coupling agent is applied. In this case, it is possible to easily form the adhesive into a predetermined shape by the coupling treatment.

According to further still another aspect of the invention, there is provided a liquid ejecting head including: a first base that has a first main surface, a second main surface that is an undersurface opposite to the first main surface, and an inclined surface that is formed between the first main surface and the second main surface to have an angle as a reference angle with the second main surface, which is less than 90 degrees; a second base that has a third main surface which is joined to the second main surface of the first base, a flow path which communicates with a nozzle opening through which a liquid is ejected and a pressure generator that causes a pressure change inside the flow path; an adhesive which is disposed between the second main surface of the first base and the third main surface of the second base from an end portion of the inclined surface of the first base to an exposed region on the third main surface of the second base and by which the first base and the second base are joined; and a connection wiring that is provided to be continuous from the inclined surface through the front surface of the adhesive to the third main surface of the second base. The front surface of the adhesive is provided to be continuous to the inclined surface and thus an angle formed between the front surface of the adhesive in a portion in which the adhesive is provided to be continuous to the inclined surface and the third main surface on which the adhesive is provided is less than the reference angle.

In this case, the adhesive by which the first base and the second base are bonded is disposed from the inclined surface to the exposed region on the third main surface of the second base and the angle formed between the front surface of the adhesive and the third main surface is less than the reference angle. Thus, it is possible to suppress variations of a thickness of the connection wiring that is formed from the adhesive to the third main surface. In addition, the connection wiring that is formed from the adhesive to the third main surface is prevented from forming a corner with an angle equal to or greater than the reference angle and thus it is possible to suppress an occurrence of breaking due to a stress concentration on the corner. In addition, since the adhesive is used, it is possible to simplify manufacturing processes and thus to decrease cost compared to using a filler or the like other than the adhesive.

According to still another aspect of the invention, there is provided a liquid ejecting apparatus including: the liquid ejecting head according to the aspect.

In this case, the connection wiring is formed with high accuracy and thus it is possible to realize a reliable and miniaturized liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
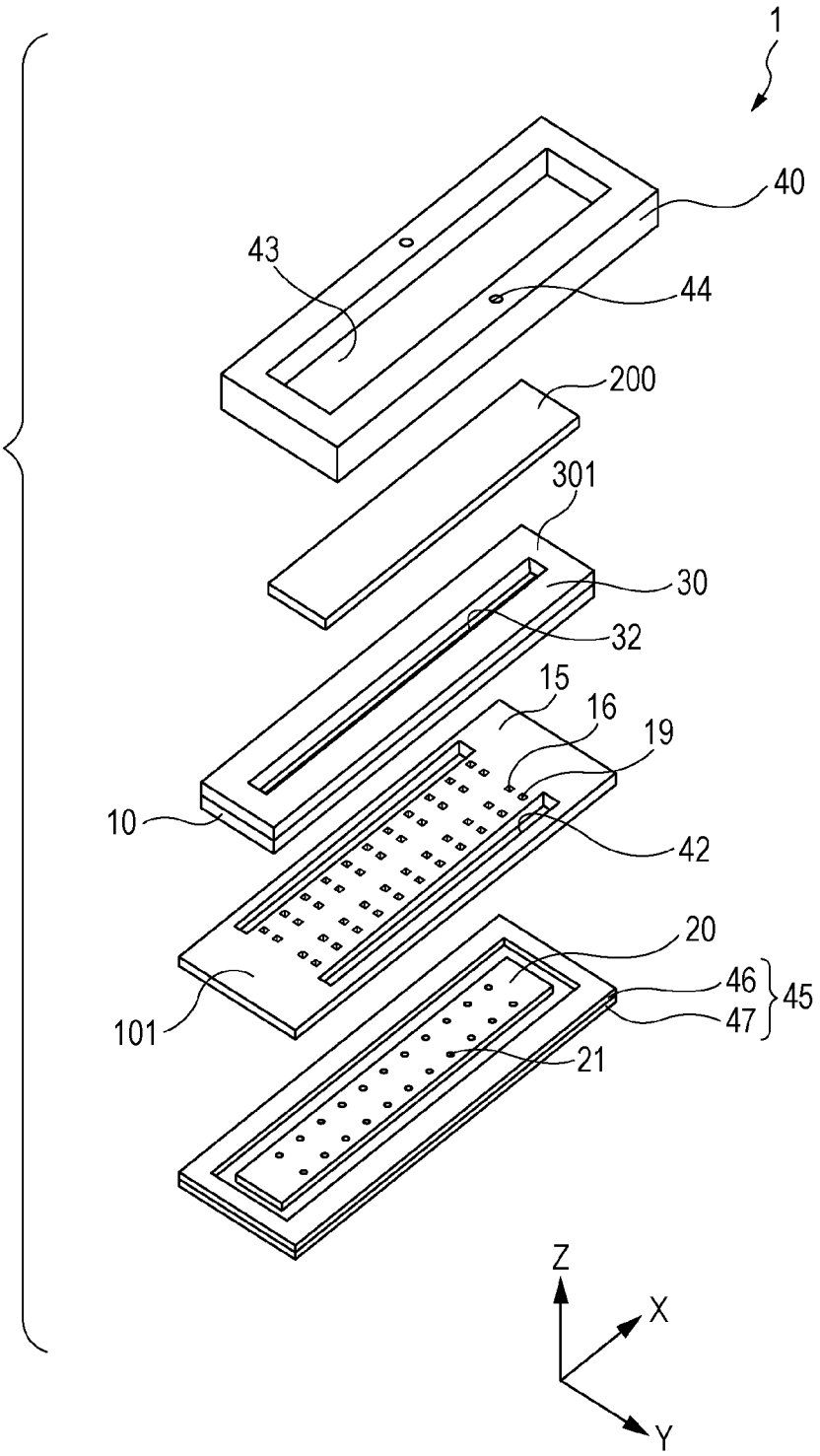
FIG. 1 is an exploded perspective view illustrating a recording head according to Embodiment 1.
Figure 2:
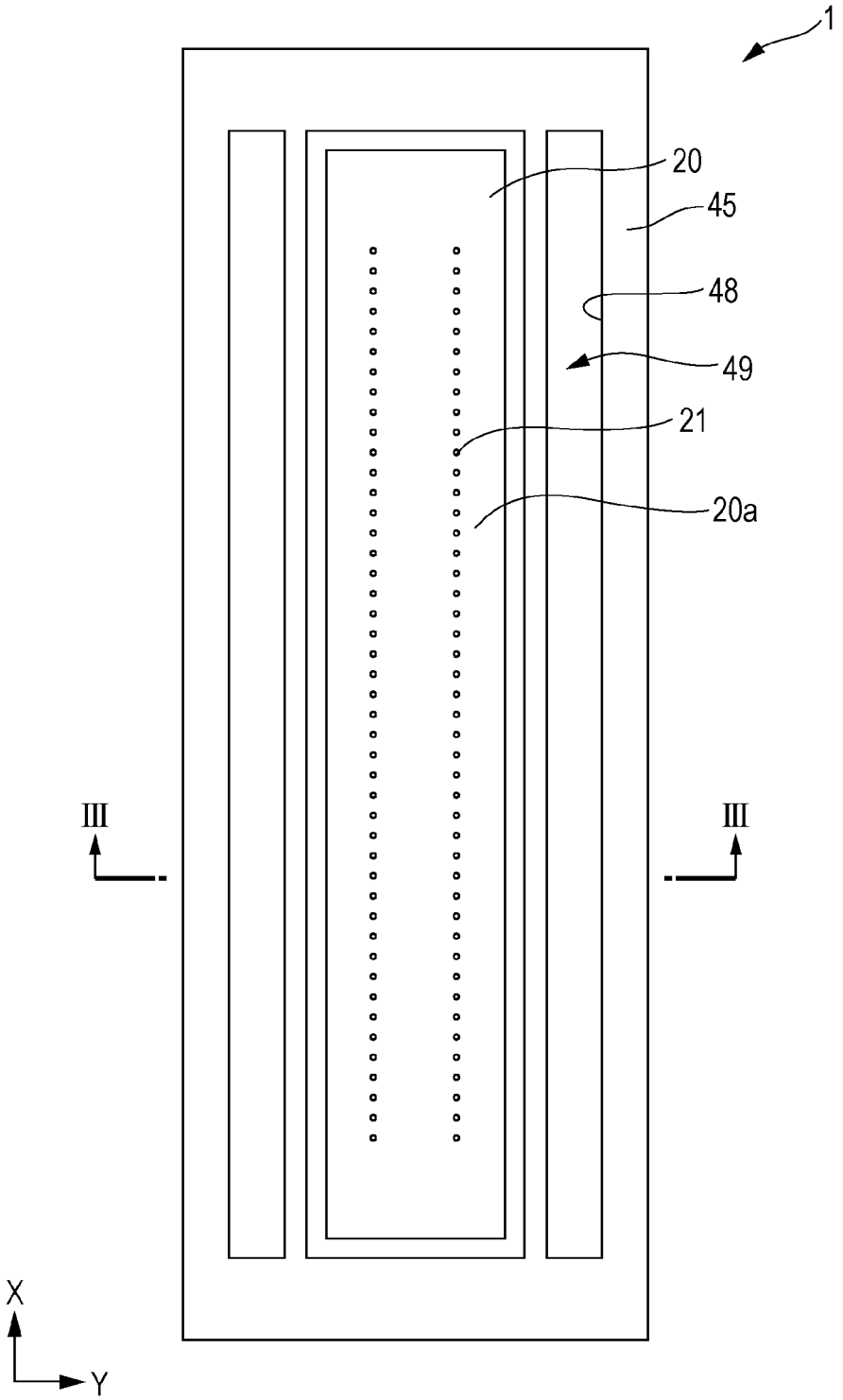
FIG. 2 is a plan view illustrating the recording head according to Embodiment 1.
Figure 3:
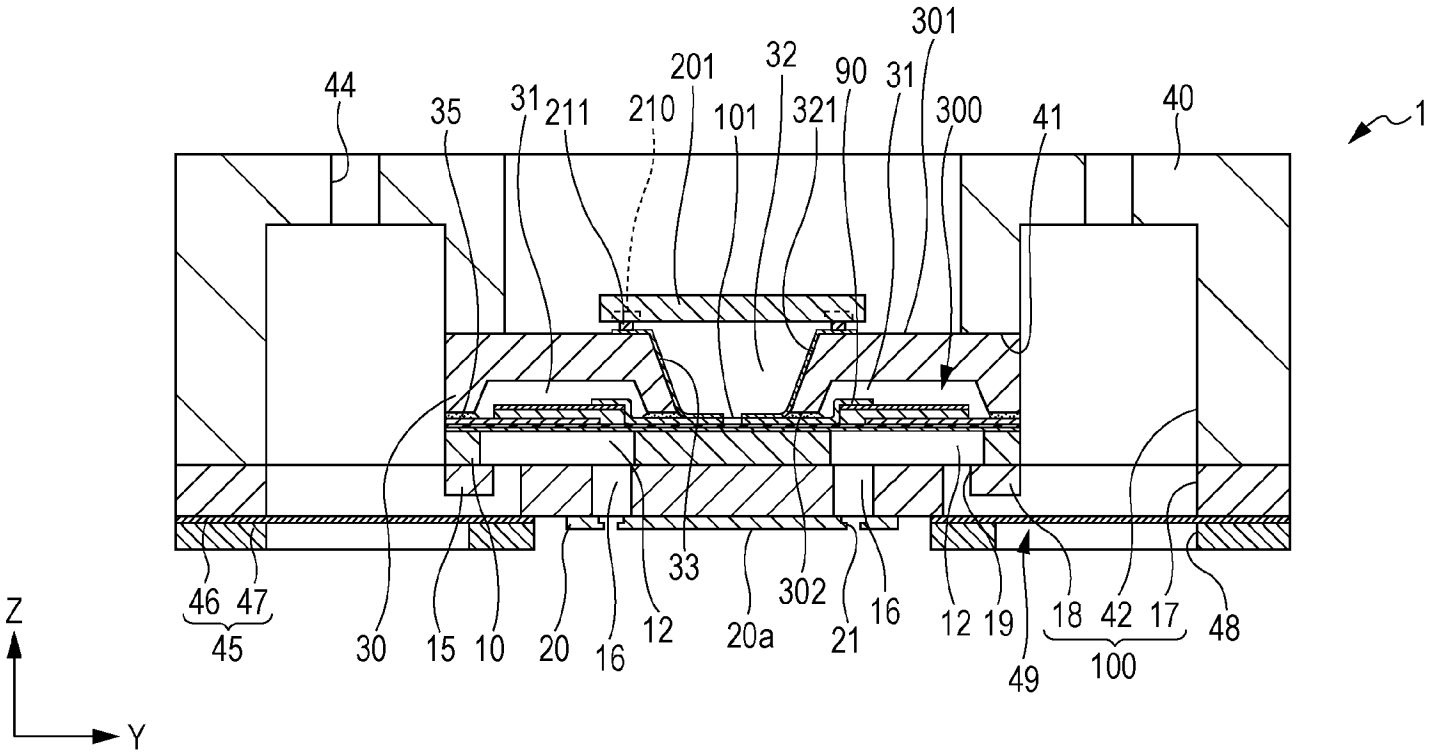
FIG. 3 is a cross-sectional view illustrating the recording head according to Embodiment 1.
Figure 4A:
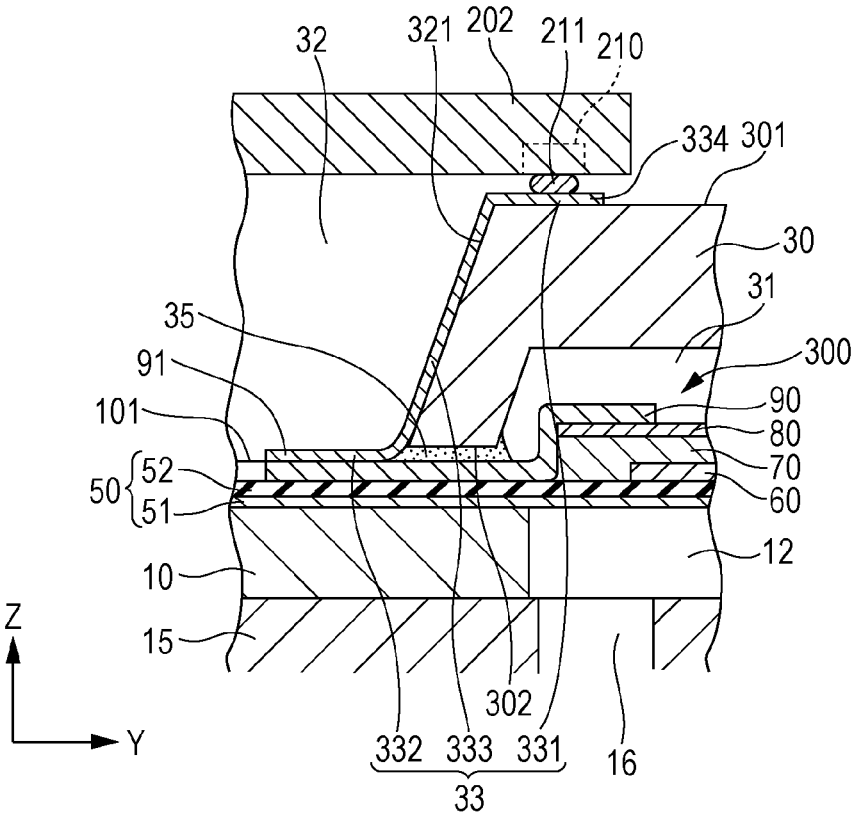
FIGS. 4A and 4B are enlarged cross-sectional views illustrating main components of the recording head according to Embodiment 1.
Figure 4B:
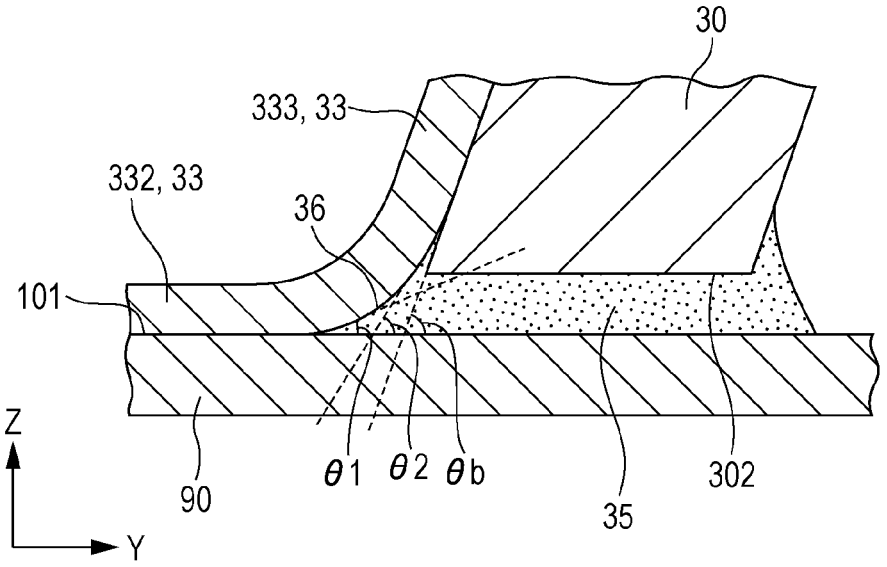
Figure 5:
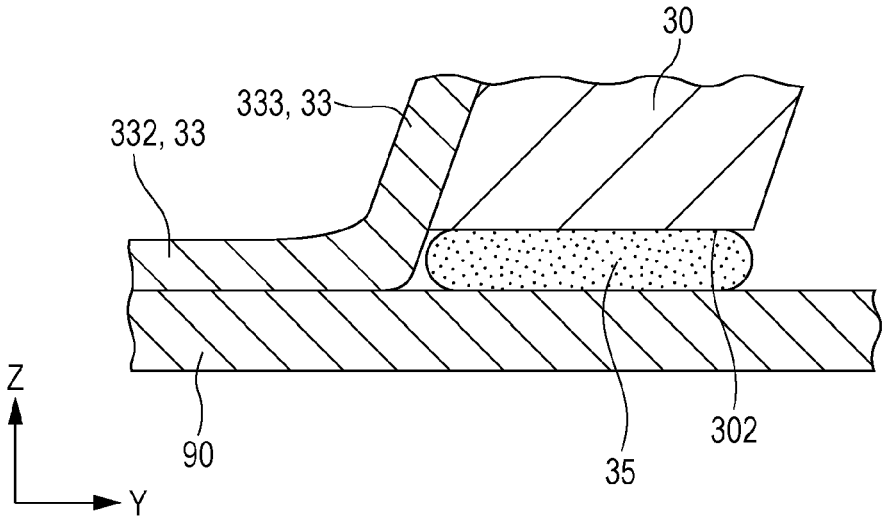
FIG. 5 is an enlarged cross-sectional view illustrating main components of a recording head according to Comparative Example.
Figure 6:
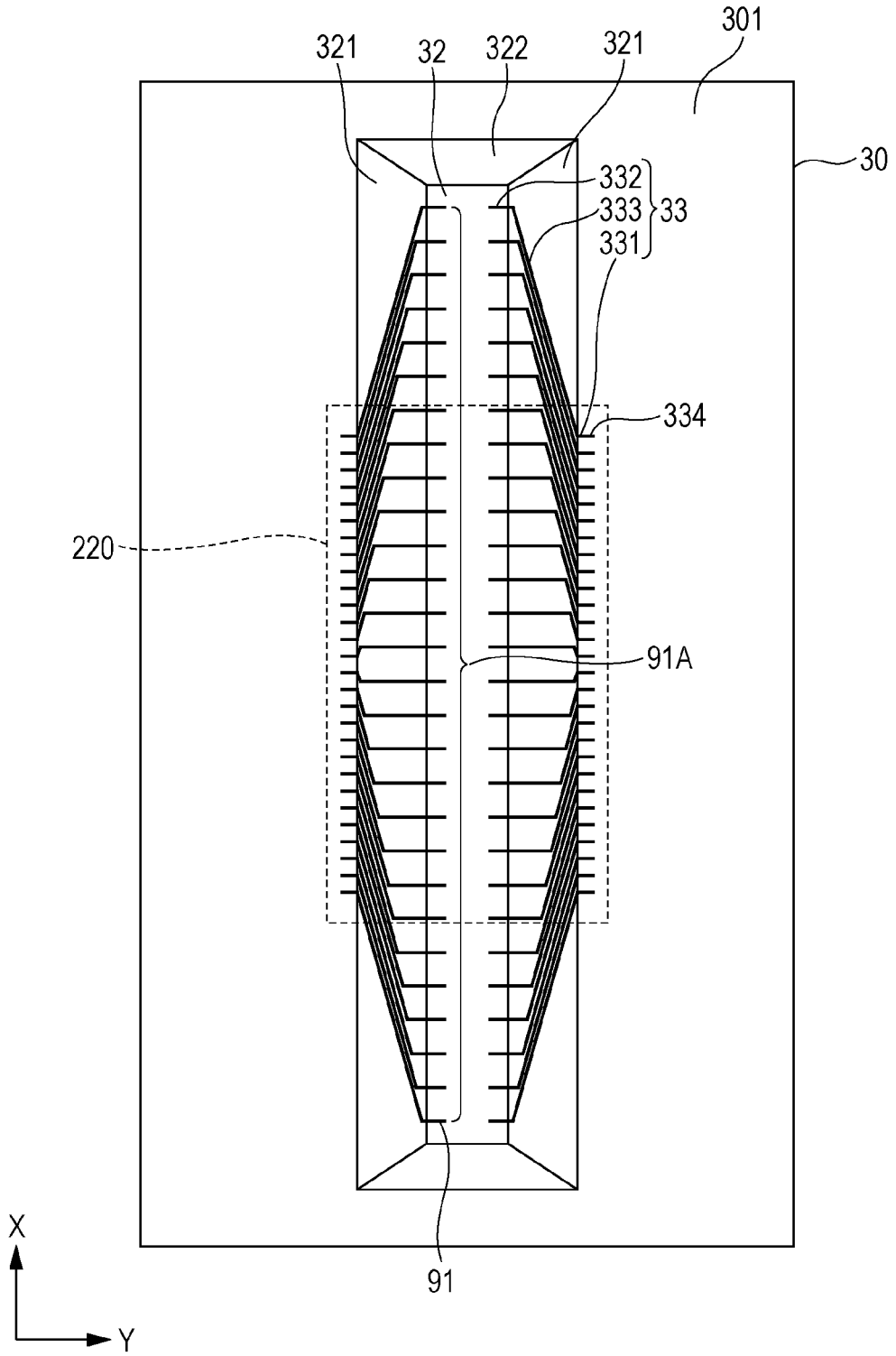
FIG. 6 is a plan view illustrating main components of the recording head according to Embodiment 1.

FIG. 1 is an exploded perspective view illustrating an ink jet-type recording head as an example of a liquid ejecting head according to Embodiment 1 of the invention. FIG. 2 is a plan view illustrating the ink jet-type recording head. In addition, FIG. 3 is a cross-sectional view taken along line III-III in FIG. 2. FIGS. 4A and 4B are enlarged views illustrating main components illustrated in FIG. 3. FIG. 5 is an enlarged cross-sectional view illustrating main components of an ink jet-type recording head according to Comparative Example. FIG. 6 is a plan view illustrating a protection substrate.

As illustrated in the drawings, the ink jet-type recording head 1 includes a plurality of members such as a flow path formation substrate 10 (second base), a communicating plate 15, a nozzle plate 20, a protection substrate 30 (first base), and a compliance substrate 45.

The flow path formation substrate 10 can be formed of a metal such as steel use stainless or Ni, a ceramic material represented by $ZrO_2$ or $Al_2O_3$, a glass-ceramic material, an oxide such as MgO, $LaAlO_3$, or the like. According to the present embodiment, the flow path formation substrate 10 is formed as a silicon single crystal substrate. In the flow path formation substrate 10, pressure generating chambers 12 that are formed by anisotropic etching from one surface side are partitioned by a plurality of diaphragms and are arranged in parallel along a direction in which a plurality of nozzle openings 21 which eject ink are arranged in parallel. From here on, this direction is referred to as a parallel-arrangement direction of the pressure generating chambers 12 or a first direction X (reference direction). In addition, in the flow path formation substrate 10, a plurality of rows of pressure generating chambers 12 in which the pressure generating chambers 12 are arranged in parallel in the first direction X are provided and two rows of pressure generating chambers 12 are provided according to the present embodiment. A row-arrangement direction, in which the plurality of rows of pressure generating chambers 12 that are formed along the first direction X are arranged, is referred to as a second direction Y, from here on. Further, according to the present embodiment, a direction which intersects with both directions of the first direction X and the second direction Y is referred to as a third direction Z. According to the present embodiment, the directions (X, Y, and Z) have orthogonal relationships with each other in order to help easy understanding of description; however, relationships between arrangements of configurations do not have to be limited to being orthogonal.

In addition, in the flow path formation substrate 10, a supply path or the like which has a smaller opening area than the pressure generating chamber 12 and causes flow path resistance to be produced to ink that flows into the pressure generating chamber 12 may be provided on one end side of the pressure generating chamber 12 in the second direction Y.

In addition, in one surface side of the flow path formation substrate 10 (−Z direction in a stacking direction), the communicating plate 15 and the nozzle plate 20 are stacked in this order. That is, the flow path formation substrate 10 includes the communicating plate 15 that is provided on one surface of the flow path formation substrate 10 and the nozzle plate 20 that has the nozzle opening 21 which is provided on the surface side of the communicating plate 15 opposite to the flow path formation substrate 10.

A nozzle communication path 16 through which the pressure generating chamber 12 communicates with the nozzle opening 21 is provided in the communicating plate 15. The communicating plate 15 has a larger area than the flow path formation substrate 10 and the nozzle plate 20 has a smaller area than the flow path formation substrate 10. The communicating plate 15 is provided in such a way that the nozzle opening 21 of the nozzle plate 20 is separated from the pressure generating chamber 12. Therefore, ink in the pressure generating chamber 12 is unlikely to be affected by thickening of ink due to evaporation of moisture which occurs in the ink in the vicinity of the nozzle opening 21. In addition, since the nozzle plate 20 is provided only to cover an opening of the nozzle communication path 16 through which the pressure generating chamber 12 communicates with the nozzle opening 21, it is possible to relatively decrease the area of the nozzle plate 20 and thus it is possible to reduce cost. According to the present embodiment, a surface on which the nozzle opening 21 of the nozzle plate 20 is opened and through which ink droplets are discharged is referred to as a liquid ejection surface 20*a*.

In addition, a first manifold section 17 and a second manifold section (throttling flow path or orifice flow path) 18 which configure a part of a manifold 100 are provided in the communicating plate 15.

The first manifold section 17 is provided to go through the communicating plate 15 in the thickness direction (the stacking direction of the communicating plate 15 and the flow path formation substrate 10).

In addition, the second manifold section 18 is not provided to go through the communicating plate 15 in the thickness direction but provided to be opened on the nozzle plate 20 side of the communicating plate 15.

Further, a supply communication path 19 that communicates with one end portion of the pressure generating chamber 12 in the second direction Y is provided in the communicating plate 15 to be separated for each of the pressure generating chambers 12. Through the supply communication path 19, the second manifold section 18 communicates with the pressure generating chamber 12.

Such a communicating plate 15 can be formed of a metal such as steel use stainless or Ni, ceramic such as zirconium, or the like. It is preferable that the communicating plate 15 be formed of a material that has the same linear expansion coefficient as the flow path formation substrate 10. That is, in a case where the communicating plate 15 is formed of a material which has the linear expansion coefficient that is greatly different from that of the flow path formation substrate 10, distortion due to the different linear expansion coefficients of the flow path formation substrate 10 and the communicating plate 15 is produced when the members are heated or cooled. According to the present embodiment, the communicating plate 15 is formed of the same material as the flow path formation substrate 10, that is, a silicon single crystal substrate, and thereby it is possible to suppress an occurrence of distortion due to heating, cracking or peeling due to heating, or the like.

The nozzle opening 21 that communicates with each of the pressure generating chambers 12 through the nozzle communication path 16 is formed on the nozzle plate 20. Such nozzle openings 21 are arranged in parallel in the first direction X and two rows of the nozzle openings 21 arranged in parallel in the first direction X are formed in the second direction Y.

Such a nozzle plate 20 can be formed of a metal such as steel use stainless (SUS), an organic material such as a polyimide resin, a silicon single crystal substrate, or the like. When the nozzle plate 20 is formed of a silicon single crystal substrate, the nozzle plate 20 has the same linear expansion coefficient as the communicating plate 15. Accordingly, it is possible to suppress an occurrence of distortion due to heating or cooling, cracking or peeling due to heating, or the like.

Meanwhile, a vibration plate 50 is formed on the surface side opposite to the communicating plate 15 of the flow path formation substrate 10. According to the present embodiment, as the vibration plate 50, an elastic film 51 that is provided on the side of the flow path formation substrate 10 and is formed of silicon oxide, and an insulator film 52 that is provided on the elastic film 51 and is formed of zirconium oxide are provided. A liquid flow path such as the pressure generating chamber 12 is formed by anisotropic etching on the flow path formation substrate 10 from one surface side (surface side to which the nozzle plate 20 is joined) and the other surface of the liquid flow path such as the pressure generating chamber 12 is partitioned by the elastic film 51.

In addition, a piezoelectric actuator 300 that is a pressure generator according to the present embodiment and includes a first electrode 60, a piezoelectric layer 70, and a second electrode 80 is provided on the vibration plate 50 of the flow path formation substrate 10. The piezoelectric actuator 300 that is the pressure generator according to the present embodiment corresponds to a drive element. Here, the piezoelectric actuator 300 is a portion in which the first electrode 60, the piezoelectric layer 70, and the second electrode 80 are included. In general, one electrode of the piezoelectric actuator 300 is used as a common electrode and the other electrode is configured to be patterned for each of the pressure generating chambers 12. According to the present embodiment, the first electrode 60 provided to be continuous over a plurality of the piezoelectric actuators 300, thereby being used as the common electrode and the second electrode 80 is provided to be separated for each of the piezoelectric actuators 300, thereby being used as an individual electrode. Understandably, in a case of a drive circuit or wiring, both of the electrodes may be used the other way around. In the above example, the vibration plate 50 is configured to include the elastic film 51 and the insulator film 52, the configuration is not limited thereto. For example, as the vibration plate 50, either the elastic film 51 or the insulator film 52 may be provided and only the first electrode 60 may be used as the vibration plate without providing the elastic film 51 and the insulator film 52 as the vibration plate 50. In addition, the piezoelectric actuator 300 itself may function as the vibration plate, in practice.

The piezoelectric layer 70 is formed of a piezoelectric material of an oxide which has a polarization structure that is formed on the first electrode 60, and for example, can be formed of a perovskite oxide which is represented by Expression of $ABO_3$, and can be formed of a lead-based piezoelectric material that includes lead, a lead-free piezoelectric material that does not include lead, or the like.

In addition, one end portion of a lead electrode 90 that is a lead wiring is connected to each of the second electrodes 80 of the piezoelectric actuator 300. The lead electrode 90 is lead out from one end portion of the second electrode 80 onto the vibration plate 50 and the other end portion extends between rows of the piezoelectric actuators 300, which are adjacent to each other in the second direction Y. Here, the other end portion of the lead electrode 90 that is led out becomes a connection terminal 91 that is connected to a drive circuit which is a semiconductor element which will be described later in detail. According to the present embodiment, a connection terminal row 91A in which the connection terminals 91 are arranged in parallel in the first direction X that is the reference direction according to the present embodiment is formed for each row of the piezoelectric actuators 300. That is, two connection terminal rows 91A which are configured to include the connection terminals 91 arranged in parallel in the first direction X are arranged in parallel in the second direction Y. According to the present embodiment, the connection terminals 91 are arranged in parallel at a second pitch d2 which is the same as the pitch of the piezoelectric actuator 300 in the first direction X. The second pitch d2 according to the present embodiment is a distance between center lines of two connection terminals 91 adjacent in the first direction X. That is, according to the present embodiment, the lead electrode 90 extends from an end portion of the piezoelectric actuator 300 along a straight line in the first direction X. In addition, the flow path formation substrate 10 in which such connection terminals 91 are provided corresponds to a second base and a surface of the flow path formation substrate 10 on the side of the protection substrate 30, that is, a surface of the vibration plate 50 on the side of the protection substrate 30 is referred to as a third main surface 101.

In addition, the protection substrate 30 that is substantially the same size as the flow path formation substrate 10 is joined to a surface of the flow path formation substrate 10 on the side of the piezoelectric actuator 300. According to the present embodiment, the protection substrate 30 corresponds to a first base, a surface opposite to a surface of the protection substrate 30 to which the flow path formation substrate 10 is joined is referred to as a first main surface 301, and a surface which is joined to the flow path formation substrate 10 is referred to as a second main surface 302. That is, the third main surface 101 of the flow path formation substrate 10 which is the second base is joined to the second main surface 302 of the protection substrate 30 which is the first base. The second main surface 302 of the protection substrate 30 that is the first base is disposed substantially in a parallel with the third main surface 101 of the flow path formation substrate 10 which is the second base.

It is preferable that such a protection substrate 30 be formed of a material which has substantially the same coefficient of thermal expansion as the flow path formation substrate 10, for example, of glass, a ceramic material, or the like. According to the present embodiment, the protection substrate 30 is formed of a silicon single crystal substrate of the same material as the flow path formation substrate 10. In addition, there is no limitation to a method of joining the flow path formation substrate 10 and the protection substrate 30, and for example, according to the present embodiment, the flow path formation substrate 10 and the protection substrate 30 are joined by an adhesive 35.

In addition, the protection substrate 30 includes a holding section 31 that is a space for protecting and accommodating the piezoelectric actuator 300 on the side of the second main surface 302. The holding section 31 is not provided to go through the protection substrate 30 in the third direction Z that is the thickness direction, but has a concave shape in which the holding section 31 opens on the side of the flow path formation substrate 10. In addition, according to the present embodiment, the holding section 31 is provided to be separated for each row of the piezoelectric actuators 300 which are arranged in parallel in the first direction X. That is, the holding section 31 is provided to be continuous through the row in which the piezoelectric actuators 300 are arranged in parallel in the first direction X and the holding sections 31 for each row of the piezoelectric actuators 300, that is, two holding sections 31 are arranged in parallel in the second direction Y. It is sufficient that such a holding section 31 have space to the extent that motion of the piezoelectric actuator 300 is not interfered with, and the space may be formed to be airtight or not to be airtight.

In addition, the protection substrate 30 includes a through-hole 32 that is provided to go through in the third direction Z that is the thickness direction and is an opening according to the present embodiment. The through-hole 32 is provided to be continuous between two holding sections 31 arranged in parallel in the second direction Y and to be continuous through the first direction X that is a parallel-arrangement direction of the plurality of piezoelectric actuators 300. That is, the through-hole 32 is formed in a groove shape along the first direction X. That is, the through-hole 32 is formed to be an opening having a long side in the parallel-arrangement direction of the plurality of piezoelectric actuators 300.

First side wall sections 321 that are walls on both sides of such a through-hole 32 in the second direction Y are formed of an inclined surface provided to be inclined between the first main surface 301 and the second main surface 302 as illustrated in FIGS. 4A and 4B. That is, the first side wall sections 321 that are inclined surfaces extend in the first direction X which is the reference direction. Here, the first side wall section 321 has the inclined surface, which means that the first side wall section 321 is provided to be inclined with respect to the first main surface 301 and the second main surface 302. That is, this means that the first side wall section 321 is not formed in the same plane direction as the first main surface 301 and the second main surface 302 and the first side wall section 321 is not provided in the same plane direction as the third direction Z orthogonal to the first main surface 301 and the second main surface 302. That is, the first side wall section 321 is provided to be inclined even to the third direction Z. There is no particular limitation to an angle of the inclination of the first side wall section 321; however, in a case where the protection substrate 30 is formed of the silicon single crystal substrate, for example, the first side wall section 321 is inclined to have an angle of 54.7 degrees with respect to the second main surface 302 depending on a plane orientation of the silicon single crystal substrate. In addition, an interval between two first side wall sections 321 facing each other in the second direction Y is provided to be gradually larger along a direction in which the first side wall section 321 is separated from the flow path formation substrate 10 in the third direction Z.

According to the present embodiment, similar to the first side wall section 321, two second side wall sections 322 which are both side walls of the through-hole 32 in the first direction X are also provided to be inclined with respect to the first main surface 301 and the second main surface 302. The first side wall sections 321 and the second side wall sections 322 are provided to be inclined and thereby the through-hole 32 can be formed easily, for example, by etching with high accuracy.

A part of the third main surface 101 (part of the vibration plate 50) of the flow path formation substrate (second base) 10 is exposed in the through-hole 32 in such a protection substrate 30 and thus the connection terminal 91 that is the end portion of the lead electrode 90 which is led out from the piezoelectric actuator 300 is provided to be exposed in the region.

Specifically, a portion of the lead electrode 90 which is led out to the region on the inner side of the through-hole 32 and is exposed forms the connection terminal 91. A group of the plurality of connection terminals 91 arranged in parallel in the first direction X on the third main surface 101 of the flow path formation substrate 10 is referred to as the connection terminal row 91A. According to the present embodiment, two connection terminal rows 91A are arranged in parallel in the second direction Y in the portion (region on the inner side of the through-hole 32) of the third main surface 101 which is exposed by the through-hole 32.

Here, the adhesive 35 by which the flow path formation substrate 10 and the protection substrate 30 are bonded is provided on a region between the second main surface 302 of the protection substrate 30 and the third main surface 101 of the flow path formation substrate 10 and is provided from this region to protrude onto the third main surface 101 inside the through-hole 32 of the flow path formation substrate 10.

Such an adhesive 35 has a front surface 36 exposed inside the through-hole 32, which is provided to be continuous to the first side wall section 321. To be more exact, in the second direction Y that is an extending direction of a connection wiring 33 which will be described later, an angle formed between the front surface 36 of the adhesive 35 in a portion where the front surface 36 is continuous to the first side wall section 321 and the third main surface 101 on which the adhesive 35 is provided is less than a reference angle θb which is formed between the first side wall section 321 and the third main surface 101. Here, the angle formed between the front surface 36 of the adhesive 35 and the third main surface 101 in the second direction Y is an angle between a tangential direction and the third main surface 101 in a case where the front surface 36 of the adhesive 35 is formed to be a curved surface. That is, the front surface 36 of the adhesive 35 has an angle that is less than the reference angle θb with respect to the third main surface 101 in an entire region in the second direction Y that is the extending direction of the connection wiring 33.

Specifically, an angle θ1 between the front surface 36 and the third main surface 101 is formed to be less than the reference angle θb in a portion of a contact point of the front surface 36 of the adhesive 35 to the third main surface 101 in the second direction Y that is the extending direction of the connection wiring 33. In addition, an angle θ2 between the front surface 36 and the third main surface 101 is formed to be less than the reference angle θb in a portion of a contact point of the front surface 36 of the adhesive 35 to the first side wall section 321 in the second direction Y. Thus, the front surface 36 of the adhesive 35 is formed to have an angle between the angle θ1 and the angle θ2. That is, the front surface 36 of the adhesive 35 according to the present embodiment forms an angle with the third main surface 101 which becomes gradually smaller from the first side wall section 321 toward the third main surface 101. That is, the front surface 36 of the adhesive 35 forms an angle with the third main surface 101 which is reduced continuously in a direction in which the front surface 36 is separated from the first side wall section 321 and the thickness of the adhesive 35 gradually becomes smaller in the third direction Z. Accordingly, the front surface 36 of the adhesive 35 is not provided to have a convex shape, that is to protrude on the side of the connection wiring 33 between the region in which the front surface 36 is continuous to the first side wall section 321 and the region in which the front surface 36 is continuous to the third main surface 101, but is formed to have a concave shape. The front surface 36 of the adhesive 35 is formed into the concave shape, which means that the front surface 36 is formed to be positioned on the side of the third main surface 101 with respect to a straight line that connects a contact point with the third main surface 101 and a contact point with the first side wall section 321. Such a concave shape of the front surface 36 may be a polygon of a plurality of straight lines with different angles from each other, or may be a curved concave shape. The front surface 36 of the adhesive 35 according to the present embodiment is formed into a curved concave shape. The front surface 36 of the adhesive 35 may be formed into a straight line shape that connects the contact point with the third main surface 101 and the contact point with the first side wall section 321 in the second direction Y. It is preferable that, with respect to the straight line that connects the contact point with the third main surface 101 and the contact point with the first side wall section 321 in the second direction Y, the front surface 36 of the adhesive 35 be formed to be on the side of the third main surface 101 in which the straight line is included.

According to the present embodiment, the reference angle θb is represented by the angle between the first side wall section 321 and the third main surface 101, and since the third main surface 101 and the second main surface 302 are disposed practically in parallel, the reference angle θb is the same angle as that between the third main surface 101 and the first side wall section 321.

When the adhesive 35 is provided on the third main surface 101, the adhesive 35 may be directly provided on the third main surface 101 and may be provided on the third main surface 101 through another member therebetween. According to the present embodiment, the adhesive 35 is formed on the lead electrode 90 provided on the third main surface 101.

Here, as illustrated in FIGS. 4A and 4B, the angle θ1 between the front surface 36 and the third main surface 101 in the contact portion of the thin elastic section 36 of the adhesive 35 with the third main surface 101 is an angle between a boundary portion in which the front surface 36 of the adhesive 35 is in contact with the third main surface 101 and the third main surface 101. That is, in a case where the front surface 36 of the adhesive 35 is formed to have a curved surface, the contact angle θ1 of the front surface 36 of the adhesive 35 to the third main surface 101 is an angle between the tangential direction and the third main surface 101 at a contact point of the front surface 36 of the adhesive 35 to the third main surface 101.

In addition, according to the present embodiment, the adhesive 35 is disposed onto the first side wall section 321 that is the inclined surface and the front surface 36 of the adhesive 35 is provided to be continuous to the front surface of the first side wall section 321. That is, the adhesive 35 is not formed at a position that is recessed on the side of the second main surface 302 from the first side wall section 321 as illustrated in FIG. 5, but is provided to be continuous to the front surface of the first side wall section 321 as illustrated in FIGS. 4A and 4B. That is, the front surface 36 of the adhesive 35 is continuous to the front surface of the first side wall section 321, which means that the front surface 36 of the adhesive 35 is in direct contact with the front surface of the first side wall section 321 without interposing the second main surface 302 therebetween. According to the present embodiment, the adhesive 35 is disposed onto the first side wall section 321, and thereby the front surface 36 of the adhesive 35 is caused to be continuous to the front surface of the first side wall section 321; however, the configuration is not limited thereto, and the front surface 36 of the adhesive 35 may be continuous to be flush with the front surface of the first side wall section 321. Here, since it is difficult to control the front surface 36 of the adhesive 35 to be flush with the front surface of the first side wall section 321 with high accuracy, it is preferable that the adhesive 35 extend onto the first side wall section 321.

The angle θ2 between the front surface 36 and the first side wall section 321 in the contact portion of the front surface 36 of the adhesive 35 provided on the first side wall section 321 with the first side wall section 321 is formed to be less than the reference angle θb. The angle θ2 between the front surface 36 and the first side wall section 321 in the contact portion of the front surface 36 of the adhesive 35 with the first side wall section 321 is an angle between the boundary portion, in which the front surface 36 of the adhesive 35 is in contact with the first side wall section 321, and the third main surface 101 as illustrated in the drawings. That is, in a case where the front surface 36 of the adhesive 35 is formed to be a curved surface, the angle θ2 is an angle between the tangential direction in the contact point of the front surface 36 of the adhesive 35 with the first side wall section 321 and the third main surface 101.

There is no particular limitation to such an adhesive 35 and, for example, an epoxy adhesive can be used.

Figure 7:
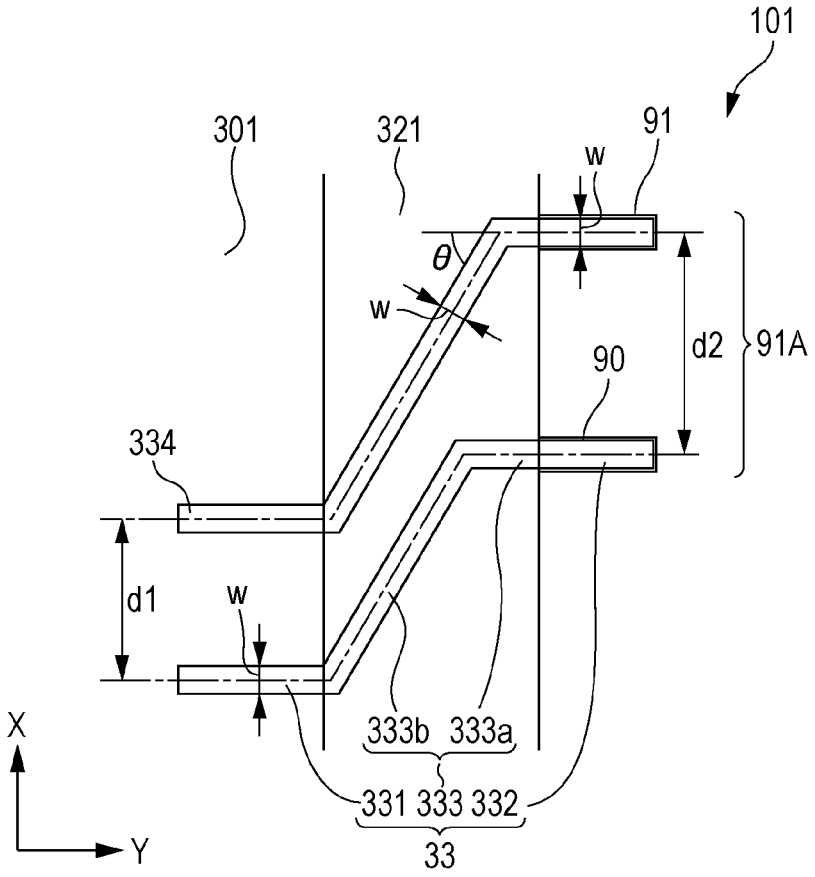
FIG. 7 is a plan view illustrating a connection wiring according to Embodiment 1.

In addition, the connection wiring 33 is formed to be continuous on the protection substrate 30, the flow path formation substrate 10, and the adhesive 35. Here, the connection wiring 33 is described in detail with reference to FIG. 7. FIG. 7 is a plan view illustrating the connection wiring.

The connection wiring 33 extends on, from the first main surface 301 through the first side wall section 321 to the third main surface 101, that is onto the connection terminal 91 of the lead electrode 90. Specifically, the connection wiring 33 is provided for each of the lead electrodes 90 and includes a first connection wiring 331 provided on the first main surface 301, a second connection wiring 332 that is provided on the side of the third main surface 101 and formed on the lead electrode 90, and an inclined-surface wiring 333 that is formed to run on the first side wall section 321 and the adhesive 35 and connects the first connection wiring 331 an the second connection wiring 332.

A plurality of connection wirings 33 are arranged in parallel in the first direction X for each row of the connection terminals 91 of the lead electrodes 90. According to the present embodiment, since the two connection terminal rows 91A of the lead electrodes 90 are provided in the second direction Y, the connection wirings 33 are provided to correspond to the connection terminal row 91A on both side of the through-hole 32 in the second direction Y, respectively.

Here, the first connection wirings 331 are provided to be arranged in parallel in the first direction X on both of the first main surfaces 301 of the through-hole 32 in the second direction Y. In addition, the first connection wiring 331 extends straightly in the second direction Y. One end portion of such a first connection wiring 331 on the first main surface 301 becomes a first wiring terminal 334 that is connected electrically to a drive circuit 200 which is a semiconductor element. The first connection wirings 331 that has the first wiring terminals 334 are arranged in parallel along the first direction X at a first pitch d1 which is narrower than the second pitch d2 of the adjacent connection terminals 91 of the lead electrodes 90. In other words, the second pitch d2 of the connection terminals 91 is wider than the first pitch d1 of the first wiring terminals 334.

The second connection wiring 332 is provided on the top surface of the connection terminal 91 of the lead electrode 90, which is a portion that is led out and exposed within the through-hole 32. The top surface of the connection terminal 91 is a surface of the connection terminal 91 on the opposite side to the flow path formation substrate 10. That is, the second connection wiring 332 extends straightly in the second direction Y and is disposed to face the connection terminal 91 of the lead electrode 90 in the third direction Z. Such second connection wirings 332 are arranged in parallel in the first direction X at the same second pitch d2 as the lead electrodes 90. These second connection wirings 332 become second wiring terminals that are connected electrically to the connection terminals 91 of the lead electrodes 90. According to the present embodiment, the second connection wiring 332 that is the second wiring terminal corresponds to a connection wiring according to the aspects of the invention.

The inclined-surface wiring 333 is formed to connect the first connection wiring 331 and the second connection wiring 332. The inclined-surface wiring 333 includes a straight portion 333*a* provided on the side of the second connection wiring 332 and an inclined portion 333*b* that is continuous to the straight portion 333*a* and is provided on the side of the first connection wiring 331. Such a straight portion 333*a* extends straightly along the second direction Y. In addition, the inclined portion 333*b* is inclined with respect to the straight portion 333*a*, that is, extends straightly in an inclined direction at an angle θ with respect to the second direction Y. Here, the straight portions 333*a* are formed at the second pitch d2 and end portions of the inclined portions 333*b* on the side of the first connection wiring 331 are formed at the first pitch d1. According to the present embodiment, the inclined portions 333*b* of all the inclined-surface wirings 333 are formed to have the same inclined angle and lengths of the straight portions 333*a* in the second direction Y are adjusted. In this way, the second pitch d2 of the straight portion 333*a* is changed into the first pitch d1 of the end portions of the inclined portion 333*b* on the side of the first connection wirings 331, that is, the first pitch d1 of the first wiring terminals 334.

Such first connection wiring 331, second connection wiring 332, and inclined-surface wiring 333 are formed to have the same width w according to the present embodiment. That is, the first connection wiring 331, the second connection wiring 332, and the inclined-surface wiring 333 are formed to have the same width w in a width in the first direction (a width in a direction orthogonal to the extending direction for the inclined portion 333*b* of the inclined-surface wiring 333). Thus, it is possible to increase resistance of the connection wiring 33 and it is possible to suppress an occurrence of disconnection or the like in the connection portion of the first connection wiring 331, the second connection wiring 332 and the inclined-surface wiring 333. In addition, when a part of the connection wiring 33 is formed to be wide in the width, an interval between the adjacent connection wirings 33 in the first direction X is decreased and there is a concern that a short circuit or migration occurs. According to the present embodiment, the connection wirings 33 are formed to have the same width w, and thereby it is possible to suppress an occurrence of disconnection, a short circuit, or migration. Understandably, the widths w of the first connection wiring 331, the second connection wiring 332, and the inclined-surface wiring 333 which configure the connection wiring 33 may not be the same width, or the widths of the first connection wiring 331, the second connection wiring 332, and the inclined-surface wiring 333 may be changed in a position of the wirings into a different width.

In addition, according to the present embodiment, the connection wiring 33 is formed to have substantially the same thickness across the front surface 36 of the adhesive 35. That is, the angles θ1 and θ2 of the front surface 36 of the adhesive 35 according to the present embodiment are less than the reference angle θb, in addition, an angle between every tangential direction of the front surface 36 and the third main surface 101 is less than the reference angle θb, and further, the front surface 36 is formed to have the curved concave shape and thus is formed to have a so-called slope shape. Therefore, when the connection wiring 33 is formed by film deposition on, from the first side wall section 321 to the lead electrode 90 on the third main surface 101, the thickness is formed to be substantially the same. Thus, it is possible to suppress an occurrence of disconnection of the connection wiring 33 on the adhesive 35. In addition, since the front surface 36 of the adhesive 35 is formed to have a slope shape, an angle equal to or greater than the reference angle θb is not formed on, through the first side wall section 321, the front surface 36 of the adhesive 35, to the lead electrode 90 on the third main surface 101. Therefore, since the connection wiring 33 provided to be continuous through on the first side wall section 321, the front surface 36 of the adhesive 35, and the lead electrode 90 does not have an angle equal to or greater than the reference angle θb either, it is possible to suppress an occurrence of breaking due to a stress concentration on a corner of the connection wiring 33 when the adhesive 35 expands. According to the present embodiment, since the front surface 36 of the adhesive 35 is formed to have particularly the curved concave shape, the connection wiring 33 on the adhesive 35 is formed also to have the curved concave shape and it is possible to suppress effectively the stress concentration to the corner or the like of the connection wiring 33.

On the other hand, when the adhesive 35 as illustrated in FIG. 5 is formed only between the second main surface 302 and the third main surface 101, a space is formed between the connection wiring 33 and the adhesive 35 depending on a method of forming the connection wiring 33. In addition, it is difficult to form a uniform thickness of the connection wiring 33. Therefore, the connection wiring 33 such as that illustrated in FIG. 5 is likely to be broken due to a factor of existence of a space or an occurrence of the stress concentration on the corner.

In addition, according to the present embodiment, since the adhesive 35 by which the flow path formation substrate 10 and the protection substrate 30 is bonded is caused to stick out and is formed into a slope shape, it is possible to simplify manufacturing processes and thus to decrease a cost compared to a case where a filler or the like other than the adhesive 35 is used.

Such a connection wiring 33 may be formed by stacking a plurality of layers. For example, an adhesion layer provided on the side of the flow path formation substrate 10 and the protection substrate 30 and a conductive layer provided on the side of the adhesion layer opposite to the flow path formation substrate 10 and the protection substrate 30 may be stacked. Here, examples of materials of which the adhesion layer is formed includes nickel (Ni), chromium (Cr), nickel chrome (NiCr), palladium (Pd), titanium (Ti), tungsten (W), titanium tungsten (TiW), or the like. In addition, examples of materials of which the conductive layer is formed includes gold (Au), copper (Cu), or the like. Understandably, another layer may be interposed between the adhesion layer and the conductive layer, or the layers may be formed to be one layer in which materials described above are mixed.

The drive circuit 200 that is the semiconductor element according to the present embodiment is mounted on the first main surface 301 of such a protection substrate 30. The drive circuit 200 is disposed on the first main surface 301 of the protection substrate 30 so as to cover at least a part of the through-hole 32. That is, the drive circuit 200 is provided at a position facing the through-hole 32 in the third direction Z. Such a drive circuit 200 is wider than the opening of the first main surface 301 of the through-hole 32 in the second direction Y and is disposed to straddle the through-hole 32 in the second direction Y. In addition, according to the present embodiment, the drive circuit 200 is shorter than the opening of the first main surface 301 of the through-hole 32 in the first direction X. The drive circuit 200 is disposed substantially at the center of the through-hole 32 such that parts of the through-hole 32 on both sides in the first direction X are exposed.

A terminal 201 that is connected electrically to the first wiring terminal 334 of the connection wiring 33 is provided in the drive circuit 200. The terminal 201 is provided on a surface of the drive circuit 200 on the side of the protection substrate 30. The terminals 201 are arranged in parallel in the first direction X on both sides of the drive circuit 200 in the second direction Y. Thus, the terminal 201 of the drive circuit 200 and the first wiring terminal 334 are connected to face each other in the third direction Z. The terminal 201 of the drive circuit 200 includes a connection portion 211 that is a metal bump and the electrical connection between the connection portion 211 and the first wiring terminal 334 is performed reliably by welding such as solder joint, or pressure bonding of using an anisotropic conductive adhesive (ACP or ACF) or non-conductive adhesive (NCP or NCF) therebetween.

As above, according to the present embodiment, since the drive circuit 200 is disposed to straddle the through-hole 32 in the second direction Y, it is possible to decrease a space to dispose the drive circuit 200 in the first main surface 301 of the protection substrate 30 as much as possible. Thus, it is possible to miniaturize the ink jet-type recording head 1.

Particularly, according to the present embodiment, since a pitch conversion is performed by the connection wiring 33, it is possible to miniaturize the drive circuit 200. Accordingly, it is possible to further decrease the space to dispose the drive circuit 200 on the protection substrate 30 and it is possible to still more miniaturize the ink jet-type recording head 1.

In addition, since the drive circuit 200 is provided to straddle the through-hole 32 in the second direction Y, it is possible to reinforce the protection substrate 30 that has a lowered rigidity due to the through-hole 32, by the drive circuit 200.

Further, since the drive circuit 200 is shorter than the through-hole 32 in the first direction X, it is possible for the through-hole 32 to communicate with the outside in both sides of the drive circuit 200 in the first direction X and to release heat in the through-hole 32. Accordingly, it is possible to suppress accumulation of heat from the drive circuit 200 or the connection wiring 33 in the through-hole 32.

A case member 40 that forms the manifold 100 communicating with a plurality of pressure generating chambers 12 is fixed to a joined body of the flow path formation substrate 10, the protection substrate 30, the communicating plate 15, and the nozzle plate 20. The case member 40 has substantially the same shape as the communicating plate 15 described above in a plan view, is joined to the protection substrate 30 and is joined also to the communicating plate 15 described above. Specifically, the case member 40 has a deep concave section 41 in which the flow path formation substrate 10 and the protection substrate 30 are accommodated on the side of the protection substrate 30. The concave section 41 has an opening with a wider area than the surface of the protection substrate 30 which is joined to the flow path formation substrate 10. In a state in which the flow path formation substrate 10 or the like is accommodated in the concave section 41, the opening surface of the concave section 41 on the side of the nozzle plate 20 is sealed by the communicating plate 15. Thus, a third manifold section 42 is portioned between the flow path formation substrate 10, the protection substrate 30 and the case member 40. The manifold 100 according to the present embodiment is configured to include the first manifold section 17 provided on the communicating plate 15, the second manifold section 18, and the third manifold section 42 partitioned by the case member 40.

Examples of materials of the case member 40 can include a resin, a metal, or the like. For example, the case member 40 is formed by molding the resin material, and thereby it is possible to mass-produce the case member 40 in a low cost.

In addition, the compliance substrate 45 is provided on a surface on which the first manifold section 17 and the second manifold section 18 of the communicating plate 15 is opened. The compliance substrate 45 seals the opening of the first manifold section 17 and the second manifold section 18 on the side of the liquid ejection surface 20*a*. According to the present embodiment, such a compliance substrate 45 includes a sealing film 46 and a fixing substrate 47. The sealing film 46 is formed of a flexible thin film (thin film with a thickness of 20 μm or less which is formed of, for example, polyphenylene sulfide (PPS), steel use stainless (SUS), or the like) and the fixing substrate 47 is formed of a hard material such as a metal such as steel use stainless (SUS). Since a region of the fixing substrate 47 which faces the manifold 100 becomes an opening 48 by removing the entire region in the thickness direction, one surface of the manifold 100 becomes the connection section 49 that is a flexible section sealed only by the flexible sealing film 46.

A feeding path 44 which communicates with the manifold 100 so as to supply ink to the manifold 100 is provided in the case member 40. In addition, a connection port 43 through which the first main surface 301 of the protection substrate 30 is exposed and through which the drive circuit 200 is accommodated inside the case member 40 is provided on the case member 40. When a signal or power to drive the drive circuit 200 is supplied from the outside, a flexible substrate or the like is inserted into and mounted on the connection port 43, then is connected electrically to the drive circuit 200 inside the connection port 43, or is connected through a wiring or the like (not illustrated) formed on the protection substrate 30.

In the ink jet-type recording head 1 having such a configuration, when ink is ejected, the ink is brought into from a liquid reservoir in which the ink is reserved through the feeding path 44 and the inside of the flow path from the manifold 100 to the nozzle opening 21 is filled with the ink. Then, pressure is applied to each of the piezoelectric actuators 300 corresponding to the pressure generating chambers 12 in accordance with a signal from the drive circuit 200, and thereby the piezoelectric actuator 300 and the vibration plate 50 are flexurally deformed. Thus, the pressure in the pressure generating chamber 12 is increased and ink droplets are ejected from a predetermined nozzle opening 21.

Figure 10A:
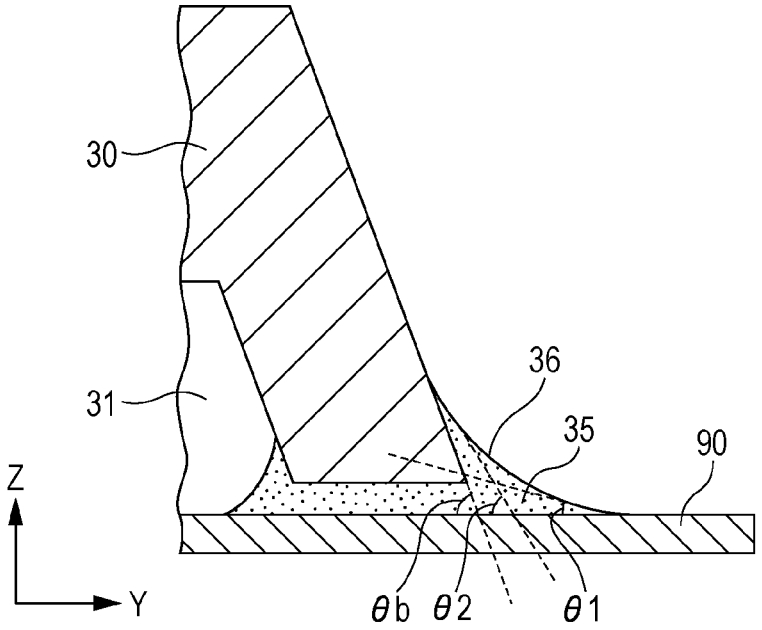
FIGS. 10A and 10B are cross-sectional views illustrating the method of manufacturing the recording head according to Embodiment 1.
Figure 10B:
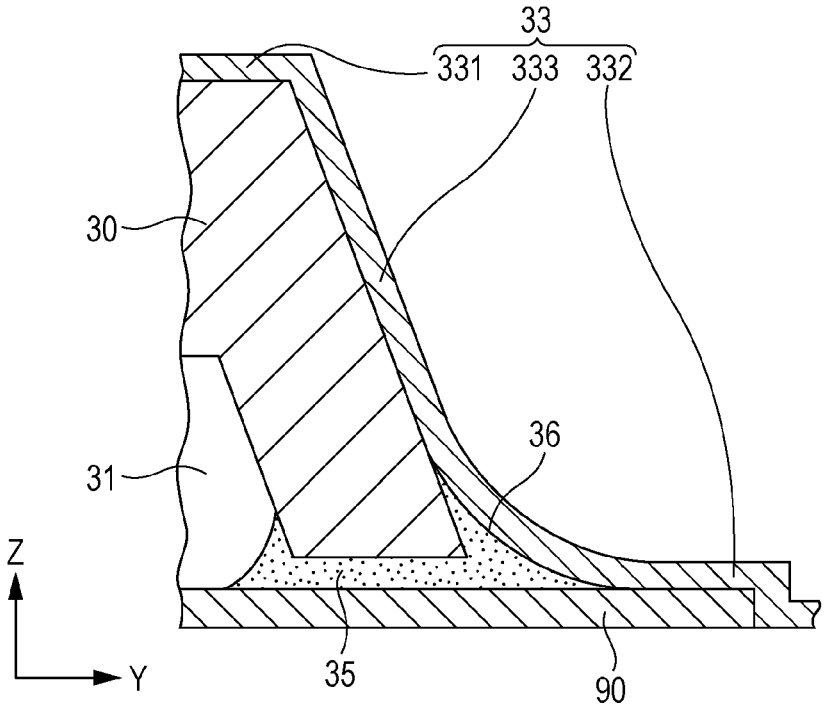
Figure 11:
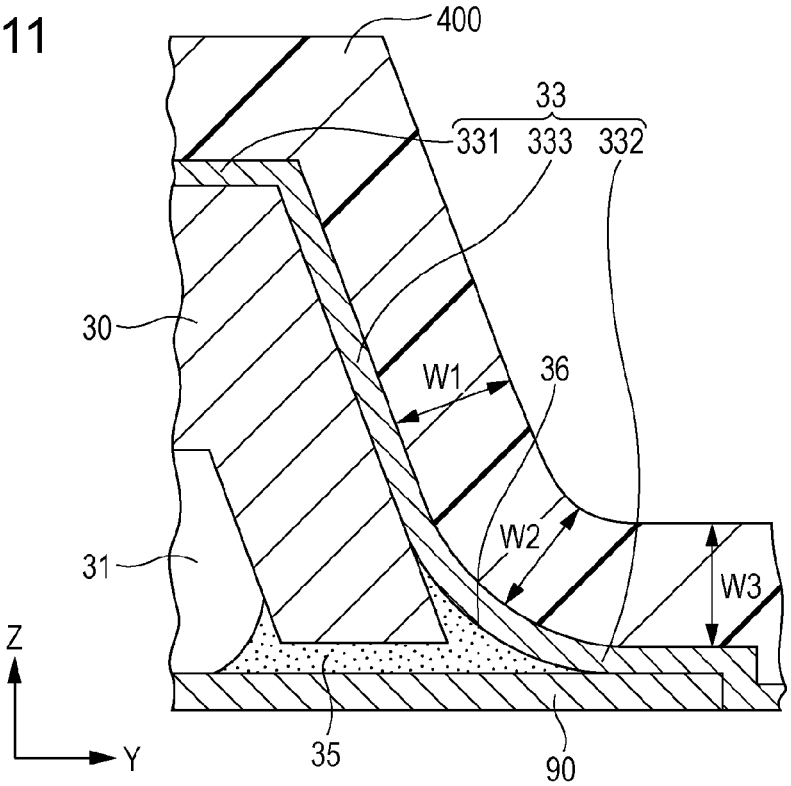
FIG. 11 is a cross-sectional view illustrating the method of manufacturing the recording head according to Embodiment 1.
Figure 12:
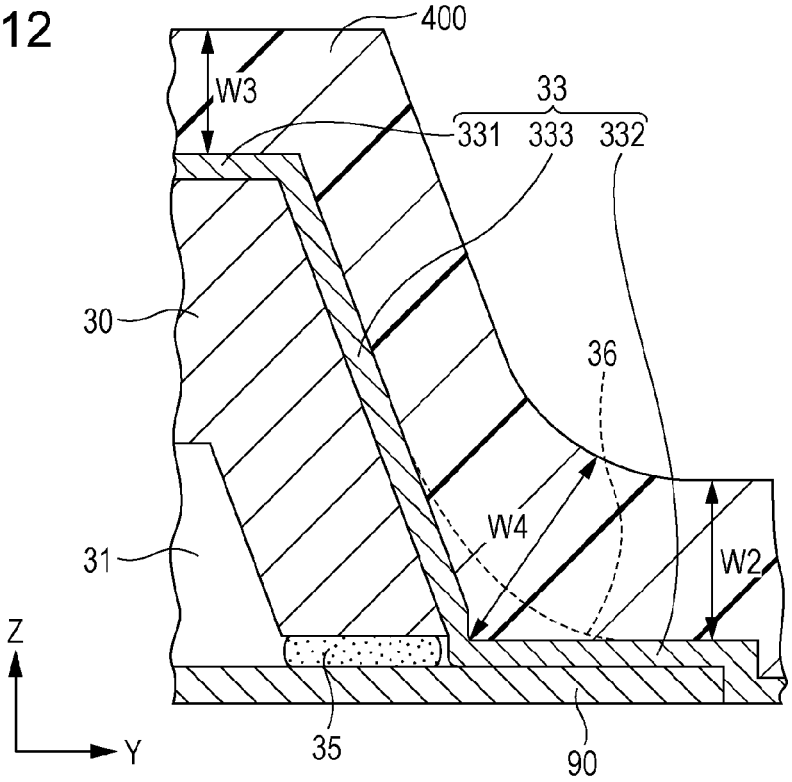
FIG. 12 is a cross-sectional view illustrating a method of manufacturing a recording head according to Comparative Example.

Here, a method of manufacturing the ink jet-type recording head according to the present embodiment is described with reference to FIGS. 8A to 15. FIGS. 8A to 11 and FIGS. 13A to 14B are cross-sectional views illustrating the method of manufacturing the ink jet-type recording head according to Embodiment 1 of the invention. In addition, FIG. 12 is a cross-sectional view illustrating a method of manufacturing an ink jet-type recording head according to Comparative Example. FIG. 15 is a plan view illustrating the connection wiring according to Comparative Example.

Figure 8A:
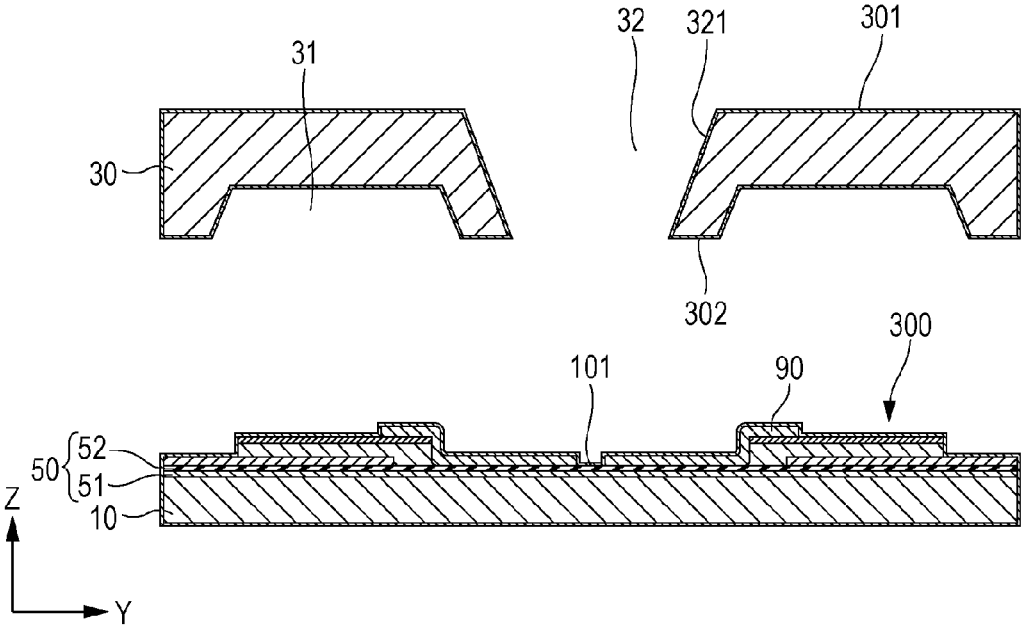
FIGS. 8A and 8B are cross-sectional views illustrating a method of manufacturing the recording head according to Embodiment 1.

First, as illustrated in FIG. 8A, before the protection substrate 30 and the flow path formation substrate 10 are joined to each other, a hydrophobic treatment, that is, a process to improve wettability is performed on the protection substrate 30 and the flow path formation substrate 10.

According to the present embodiment, the hydrophobic treatment is performed so as to improve joint strength of the adhesive 35 by which the flow path formation substrate 10 and the protection substrate 30 are bonded and so as to cause the adhesive 35 to flow out to a region of the third main surface 101 within the through-hole 32 and onto the first side wall section 321. Accordingly, the hydrophobic treatment may be performed on at least joining surface of the second main surface 302 and the third main surface 101 and on the first side wall section 321.

In addition, according to the present embodiment, as the hydrophobic treatment, a coupling treatment in which a silane coupling agent is applied is performed. Here, there is no particular limitation to a method of applying the coupling agent. For example, an aqueous solution obtained by mixing the silane coupling agent in pure water is applied and thereby organic functional groups are formed on the protection substrate 30 and the flow path formation substrate 10.

Examples of such silane coupling agents include amino-based, epoxy-based, vinyl, ureido-based, alkyl-based, methyl-based, or the like and it is possible to form organic function groups on the joining surface, similarly by using an aqueous solution obtained by using any silane coupling agents including a different functional group.

In general, before bonding by using an adhesive is performed, the aqueous solution containing such a silane coupling agent is used as a primer solution in a primer treatment which is performed so as to improve adhesion with the adhesive.

In addition, there is no limitation to a method of applying the aqueous solution containing the silane coupling agent and, for example, the flow path formation substrate 10 and the protection substrate 30 are immersed into a bath in which the aqueous solution containing the silane coupling agent is contained and thereby the aqueous solution is applied on the entire front surfaces of the flow path formation substrate 10 and the protection substrate 30. The aqueous solution is applied and the organic function groups are formed even on regions other than the third main surface 101, the second main surface 302, and the first side wall section 321 which are the joining surfaces of the flow path formation substrate 10 and the protection substrate 30. However, the aqueous solution containing the silane coupling agent does not have an effect on other regions (piezoelectric actuator 300 or wiring such as the lead electrode 90), does not cause corrosion or peeling to occur on the wirings formed of a metal film, such as the lower electrode film 60, the upper electrode film 80, and the lead electrode 90, and does not cause displacement characteristics of the piezoelectric actuator 300 or the like to be degraded. In addition, the method of applying the aqueous solution is not limited to the immersion described above and, for example, any methods such as spray coating, slit coating, or applying by using a brush may be performed. That is, according to the present embodiment, the aqueous solution applied on the joining surface does not need to be applied in a uniform thickness and a residual solution do not have any effect on other regions except the joining regions.

As an example of the hydrophobic treatment, the coupling treatment is described, there is no particular limitation thereto, and the hydrophobic treatment using a hydrophobic treatment agent other than the silane coupling agent may be performed. For example, after a dehydration treatment such as a dehydration bake is performed, the hydrophobic treatment may be performed by using hexamethyldisilazane (HMDS) that is a hydrophobic treatment agent.

Figure 8B:
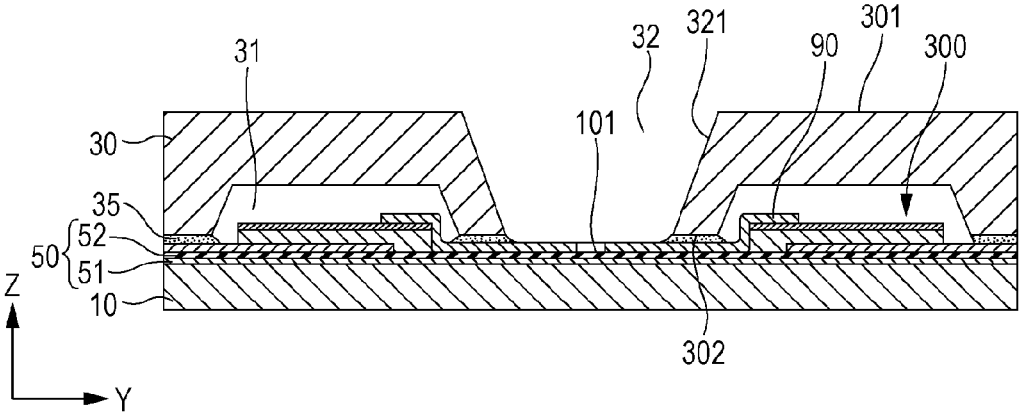

Next, as illustrated in FIG. 8B, the protection substrate 30 and the flow path formation substrate 10 are joined by the adhesive 35.

According to the present embodiment, a state in which the protection substrate 30 and the flow path formation substrate 10 are in contact with each other by the adhesive 35 is maintained at room temperature (23° C.) for a certain time (from tens of seconds to tens of hours). After the adhesive 35 is applied on the second main surface 302 and the third main surface 101, heating is performed at a temperature lower than the curing temperature of the adhesive 35 for a certain time (several minutes to several hours). Thus, the viscosity of the adhesive 35 is lowered without being cured, and thereby it is possible to cause the adhesive 35 to flow out onto the first side wall section 321 and onto the third main surface 101 (including regions on the lead electrode 90 or the like) on which the treatment to improve the wettability, that is, the coupling treatment is performed. The adhesive 35 is heated to the curing temperature and thereby the protection substrate 30 and the flow path formation substrate 10 are bonded. Thus, as illustrated in FIG. 10A, the angles θ1 and θ2 of the front surface 36 of the adhesive 35 are less than the reference angle θb and the tangential direction in the entire region of the front surface is less than θb, and further the front surface 36 has a so-called slope shape that is a curved concave surface.

As above, according to the present embodiment, since the adhesive 35 by which the flow path formation substrate 10 and the protection substrate 30 are bonded is caused to stick out and is formed into a predetermined shape, it is possible to simplify manufacturing processes and thus to decrease a cost compared to a case where a filler or the like other than the adhesive 35 is used.

According to the present embodiment, the adhesive 35 is heated at a temperature equal to or lower than the curing temperature and thereby the viscosity of the adhesive 35 is lowered before being cured. However, according to the present embodiment, since the hydrophobic treatment is performed, it is possible to cause the adhesive 35 to flow onto the first side wall section 321 and onto the third main surface 101 within the through-hole 32 and to form the shape described above without being heated at a temperature equal to or less than the curing temperature.

Figure 9A:
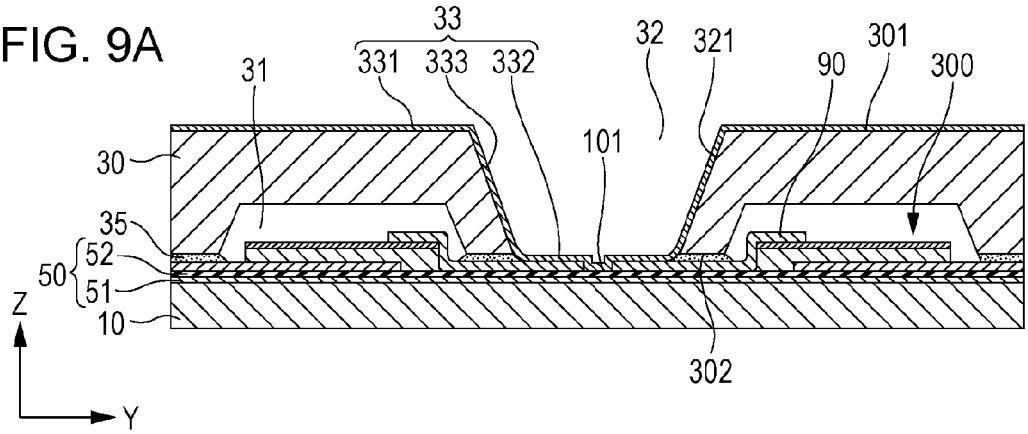
FIGS. 9A to 9C are cross-sectional views illustrating the method of manufacturing the recording head according to Embodiment 1.

Next, as illustrated in FIG. 9A, the connection wiring 33 is formed on, from the first main surface 301 of the protection substrate 30, the first side wall section 321, the front surface 36 of the adhesive 35, to the entire surface on the third main surface 101 of the flow path formation substrate 10 which is exposed by the through-hole 32. There is no limitation to a method of forming the connection wiring 33, and examples of the methods include a sputtering method, an evaporation method, a plating method, or the like. At this time, as illustrated in FIG. 10B, since the front surface 36 of the adhesive 35 has a slope shape, it is possible to form the connection wiring 33 in a substantially uniform thickness on the front surface 36 of the adhesive 35. Thus, it is possible to suppress an occurrence of failure such as disconnection of the connection wiring 33 on the adhesive 35 or the like.

On the other hand, for example, as illustrated in FIG. 12, when the front surface of the adhesive 35 is not formed into a slope shape, the thickness of the connection wiring 33 which is formed to be a film on the adhesive 35 is not uniform. Particularly, since the connection wiring 33 is formed to have an angle greater than the reference angle θb in a portion facing the adhesive 35, the thickness of the connection wiring 33 in the portion is thin. In addition, a corner with an angle equal to or greater than the reference angle θb is formed on the boundary between the first side wall section 321 and the third main surface 101. Accordingly, since the connection wiring 33 becomes thin and the strength of the connection wiring 33 is lowered in the region where the connection wiring 33 faces the adhesive 35 and the stress concentration is likely to occur in the corner, the breaking such as disconnection is likely to occur.

Figure 9B:
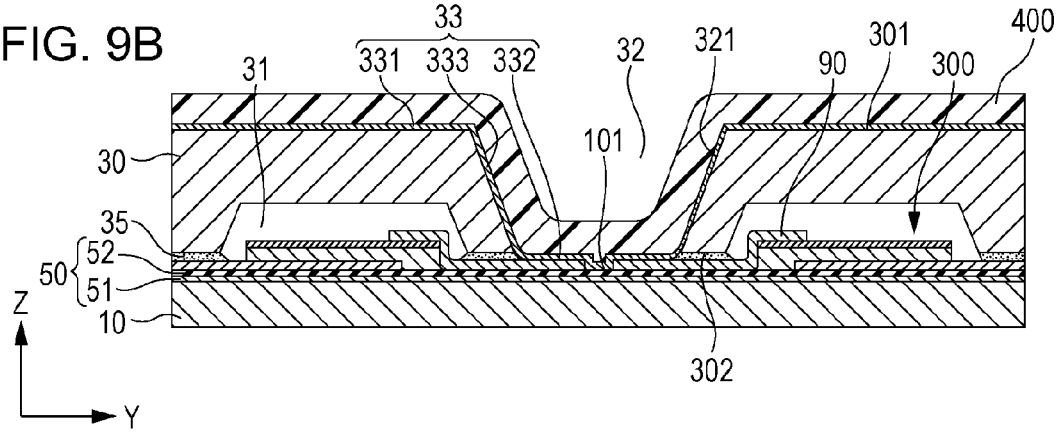

Next, as illustrated in FIG. 9B, a resist 400 is formed on the connection wiring 33. At this time, as illustrated in FIG. 11, since the front surface 36 of the adhesive 35 is formed into the so-called slope shape, the front surface of the connection wiring 33 also has the slope shape and the resist 400 formed on the connection wiring 33 is formed to have a substantially uniform thickness. That is, a thickness W1 of the resist 400 corresponding to the first side wall section 321, a thickness W2 of the resist 400 corresponding to the lead electrode 90, and a thickness W3 of the resist 400 corresponding to the adhesive 35 are formed to be substantially the same.

On the other hand, as illustrated in FIG. 12, when the adhesive 35 is not formed to satisfy the conditions according to the present embodiment, but is formed only between the third main surface 101 and the second main surface 302, the resist 400 is accumulated on a region of the boundary portion between the first side wall section 321 and the third main surface 101, in which the adhesive 35 is formed, and a thickness W4 of the boundary portion is formed to be greater than W1 and W2.

Figure 9C:
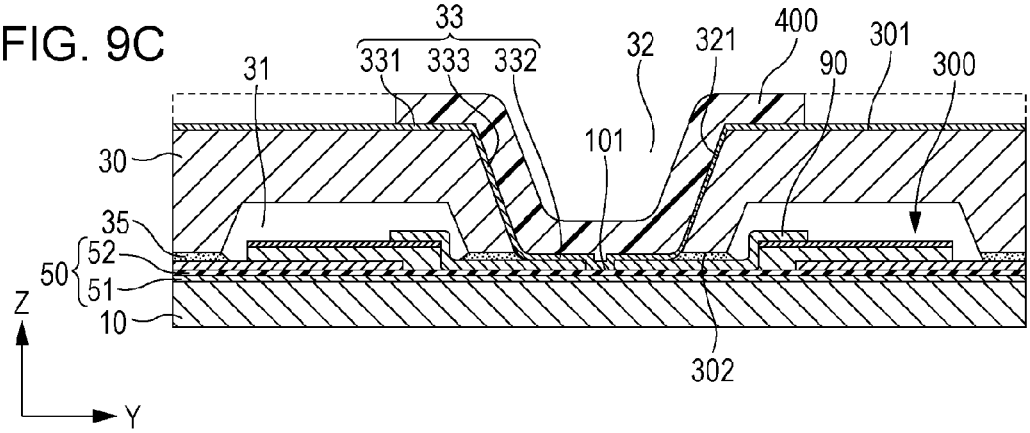

Next, as illustrated in FIG. 9C, patterning is performed on the resist 400. Specifically, the resist is exposed through an exposure mask (not illustrated) and patterning is performed by removing the exposed region through development. That is, the resist according to the present embodiment is a positive type and thus, when the resist is exposed, solubility is increased with respect to a developer, the exposed region is removed, and the patterning is performed.

As above, when the resist 400 is patterned, as illustrated in FIG. 12, and if the exposure is performed in accordance with the most thick region, that is, W4 of the resist 400, the resist 400 on the regions of W1 an W2 thinner than W4, that is, on the first side wall section 321 and the lead electrode 90 is overexposed and thus a pattern of the resist 400 is formed to have a width less than a designed value. Accordingly, when the connection wiring 33 is patterned using the resist 400, a part of the connection wiring 33 is formed to have a narrower width in accordance with the resist 400 and the disconnection of the connection wiring 33 is likely to occur. In contrast, when the exposure is performed on the resist 400 in accordance with W1 and W2 which are thinner regions than W4, underexposure in which the exposure is not sufficiently performed on W4 which is a thick region is performed and thus the resist 400 is not sufficiently removed. Then, as illustrated in FIG. 15, the connection wiring 33 corresponding to the region of W4 is formed to have a width greater than a designed value. As above, when a part of the connection wiring 33 is formed to have a width greater than the designed value, a short circuit or migration is likely to occur between the adjacent connection wirings 33. In addition, it is not possible to achieve a high dense disposition of the connection wirings 33 and thus the ink jet-type recording head 1 is increased in size.

In a case where a negative resist is used, the connection wirings 33 in the regions of W1 and W2 are formed to have a wider width when the exposure is performed in accordance with the thickness W4. The connection wiring 33 in the region of W4 is formed to have a narrower width when the exposure is performed in accordance with the thicknesses W1 and W2.

According to the present embodiment, it is possible to form the resist 400 on the connection wiring 33 to have substantially the same thicknesses W1, W2, and W3. Therefore, when the exposure is performed on the resist 400, degradation of the patterning accuracy of the connection wiring 33 due to the overexposure or underexposure is suppressed and thus it is possible to form the connection wiring 33 with high accuracy.

Figure 13A:
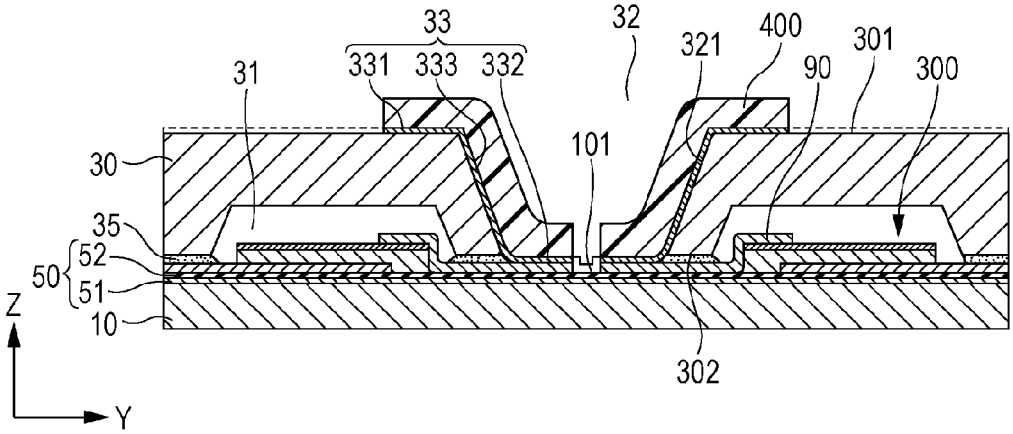
FIGS. 13A and 13B are cross-sectional views illustrating the method of manufacturing the recording head according to Embodiment 1.

Next, as illustrated in FIG. 13A, the connection wiring 33 is patterned and the resist 400 functions as a mask. The patterning of the connection wiring 33 may be performed by wet etching or dry etching.

Figure 13B:
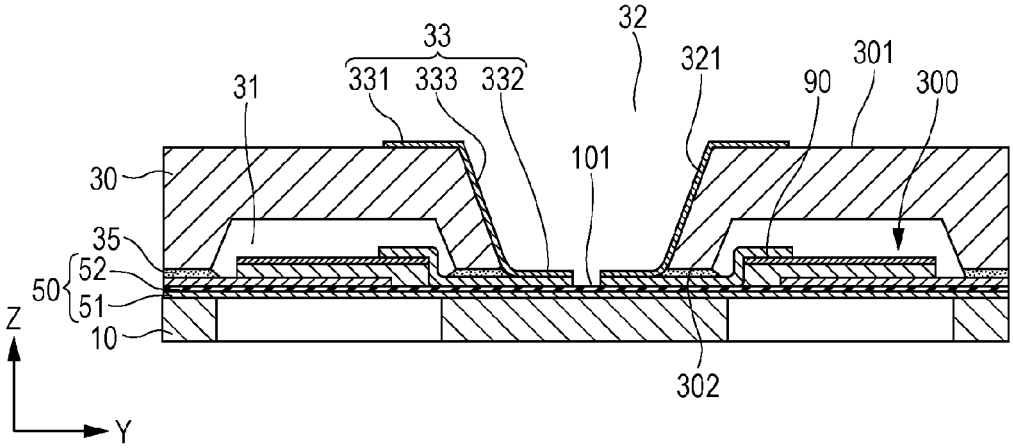

Next, as illustrated in FIG. 13B, after the resist 400 is removed, the pressure generating chamber 12 is formed by the anisotropic etching from the side of the flow path formation substrate 10 which is opposite to the piezoelectric actuator 300.

Figure 14A:
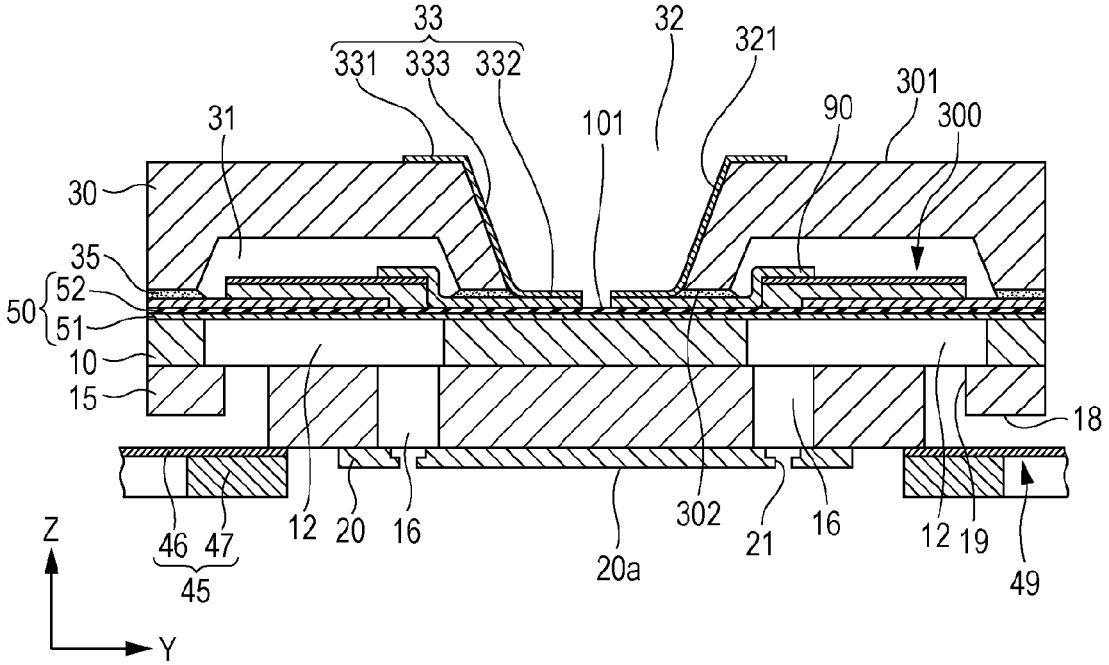
FIGS. 14A and 14B are cross-sectional views illustrating the method of manufacturing the recording head according to Embodiment 1.
Figure 15:
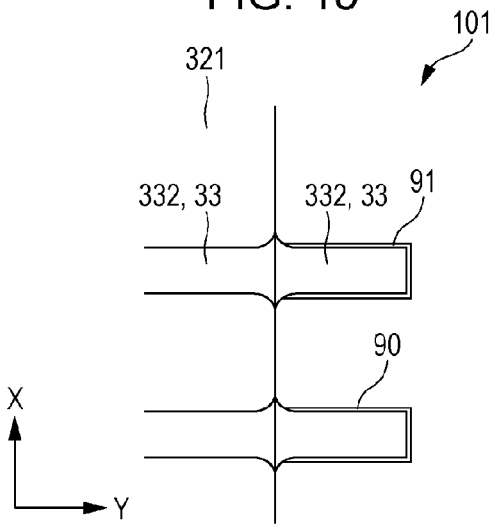
FIG. 15 is a plan view illustrating a connection wiring according to Comparative Example.

Next, as illustrated in FIG. 14A, the communicating plate 15 in which the nozzle communication path 16, the first manifold section 17, the second manifold section 18, and the like are formed, is joined to the nozzle plate 20, on which the nozzle openings 21 are formed, on the side of the flow path formation substrate 10 which is opposite to the third main surface 101.

Figure 14B:
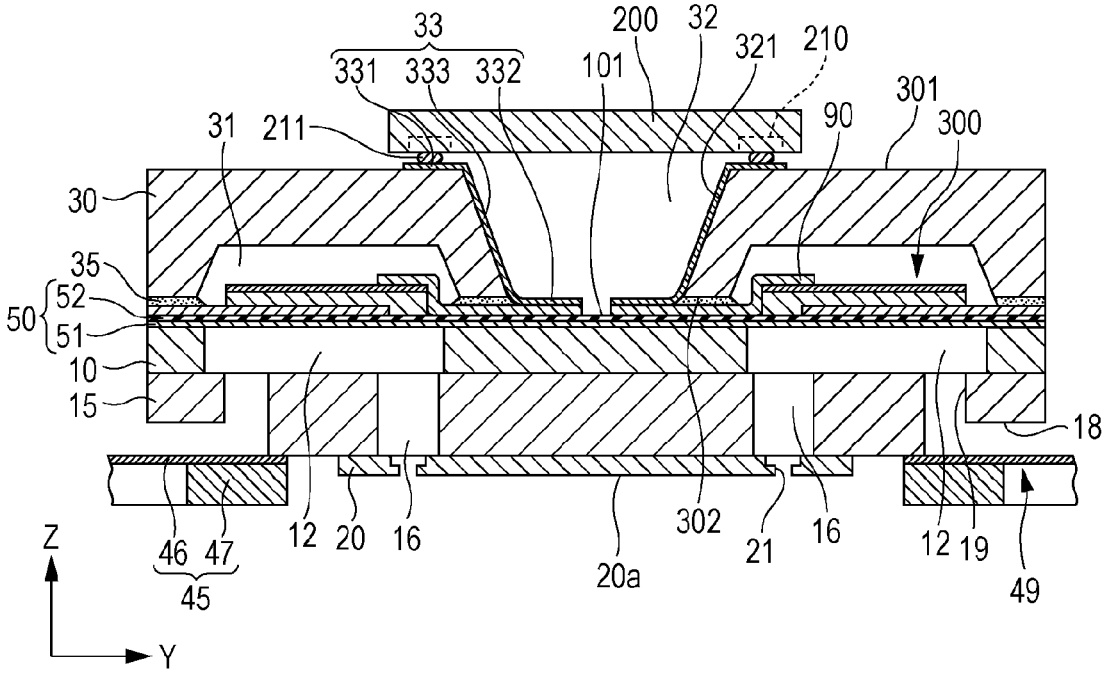

Next, as illustrated in FIG. 14B, the drive circuit 200 is mounted on the first main surface 301 of the protection substrate 30.

According to the present embodiment, the protection substrate 30 an the flow path formation substrate 10 are described, the configuration is not particularly limited thereto. A plurality of protection substrates 30 are formed integrally on one sheet of wafer and a plurality of flow path formation substrates 10 are formed integrally on one sheet of wafer. After these substrates are joined to each other, the joined substrates may be cut into a chip size illustrated in FIG. 1. When such cutting is performed after the pressure generating chamber 12 or the like illustrated in FIG. 13B is formed, it is possible to form a plurality of flow path formation substrates 10 and protection substrates 30 simultaneously.

Another Embodiment

As above, one embodiment of the invention is described, but the basic configuration of the invention is not limited to the above description.

For example, according to Embodiment 1 described above, the angle between the front surface 36 of the adhesive 35 and the third main surface 101 is less than the reference angle θb, and the front surface 36 of the adhesive 35 is formed to have the concave shape, that is, with respect to a straight line connecting the contact point of the front surface 36 with the third main surface 101 and the contact point of the front surface 36 with the first side wall section 321, the front surface 36 of the adhesive 35 is provided on the side of the third main surface 101 in which a straight line is included; however, the configuration is not limited thereto. For example, the front surface 36 of the adhesive 35 may have a convex shape, that is, the front surface 36 of the adhesive 35 may be provided on the first main surface 301 with respect to the line connecting the contact point of the front surface 36 with the third main surface 101 and the contact point of the front surface 36 with the first side wall section 321. Here, even when the front surface 36 has a convex shape, the angle between the front surface 36 and the third main surface 101 may be less than the reference angle θb.

In addition, according to Embodiment 1 described above, the drive circuit 200 is mounted on the protection substrate 30 to straddle over the through-hole 32; however, the configuration is not limited thereto. The drive circuit 200 may be mounted on one of both sides or on both sides of the through-hole 32 of the protection substrate 30 in the second direction Y. In addition, a flexible substrate, a rigid substrate, or the like on which the drive circuit 200 is mounted may be mounted on the protection substrate 30. In addition, according to the embodiments described above, the connection wiring 33 is formed to have the first connection wiring 331, the second connection wiring 332, and the inclined-surface wiring 333; however, the configuration is not particularly limited thereto. The connection wiring 33 may have at least the second connection wiring 332 and the inclined-surface wiring 333. That is, for example, a mounted component such as the drive circuit 200 may be connected to the inclined-surface wiring 333.

In addition, for example, according to Embodiment 1 described above, the through-hole 32 is provided in the protection substrate 30 and the first side wall section 321 which is an inclined surface is provided in the through-hole 32; however, the configuration is not particularly limited thereto. Two protection substrates 30 are separately provided with respect to one flow path formation substrate 10 and end surfaces of two protection substrates 30 facing each other may be inclined surfaces.

Further, according to Embodiment 1 described above, as the pressure generator that causes the pressure change in the pressure generating chamber 12, the thin film type piezoelectric actuator 300 is described; however, the configuration is not limited thereto. For example, it is possible to use a thick film type piezoelectric actuator that is formed by a method of such as attaching green sheets or the like, a longitudinal vibration type piezoelectric actuator in which piezoelectric materials and electrode forming materials are laminated alternately and expand and contract in an axial direction. In addition, as the pressure generator, it is possible to use an actuator in which a heating element is disposed in the pressure generating chamber and bubbles that is produced by heating of the heating element causes liquid droplets to be discharged from the nozzle opening, a so-called electrostatic actuator in which static electricity is generated between a vibrating plate and an electrode, the vibrating plate is deformed by electrostatic force and thus liquid droplets are discharged from the nozzle opening.

Figure 16:
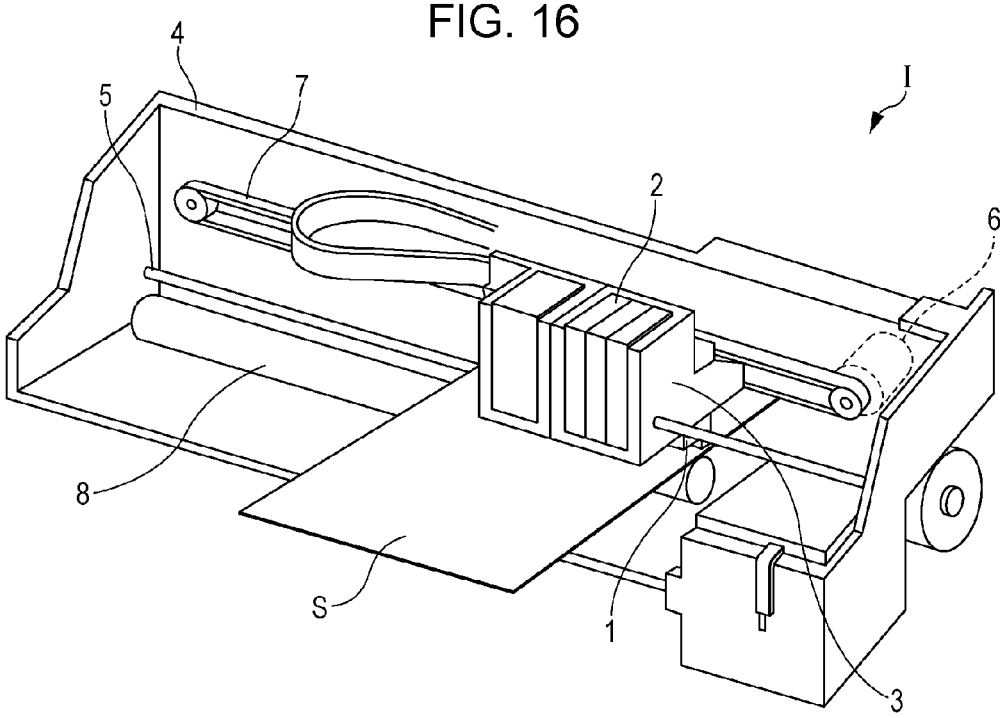
FIG. 16 is a view schematically illustrating a recording apparatus according to an embodiment of the invention.

In addition, the ink jet-type recording head 1 according to each embodiment configures a part of an ink jet-type recording head unit that includes an ink flow path communicating with an ink cartridge or the like, and is mounted on an ink jet-type recording apparatus. FIG. 16 is a view schematically illustrating the ink jet-type recording apparatus.

In an ink jet-type recording apparatus I illustrated in FIG. 16, the ink jet-type recording head 1 is provided with an ink cartridge 2 that configures an ink supplying unit and is attachable/detachable and a carriage 3 on which the ink jet-type recording head 1 is mounted is provided to be movable in the axial direction on a carriage shaft 5 attached to an apparatus main body 4.

A drive force of the drive motor 6 is transmitted to the carriage 3 through a plurality of gears (not illustrated) and a timing belt 7 and thereby the carriage 3 on which the ink jet-type recording head 1 is mounted moves along the carriage shaft 5. A transport roller 8 is provided as a transport unit in the apparatus main body 4 and a recording sheet S that is a recording medium such as paper is transported by the transport roller 8. The transport unit that transports the recording sheet S is not limited to the transport roller, but may be a belt, drum, or the like.

In the ink jet-type recording apparatus I described above, the ink jet-type recording head 1 is mounted on the carriage 3 and moves in a main scanning direction; however, the configuration is not limited thereto. For example, it is possible to apply the invention even to a so-called line-type recording apparatus in which the ink jet-type recording head 1 is fixed, the recording sheet S such as paper is caused to move only in a sub scanning direction, and thereby printing is performed.

In addition, in the examples described above, the ink jet-type recording apparatus I has a configuration in which the ink cartridge 2 that is a liquid reservoir is mounted on the carriage 3, the configuration is not limited thereto. For example, the liquid reservoir such as an ink tank is fixed to the apparatus main body 4 and the reservoir and the ink jet-type recording head 1 may be connected through a supply pipe such as a tube. In addition, the liquid reservoir may be mounted on the ink jet-type recording apparatus.

Further, broad parts of a liquid ejecting head in general are targets of the invention and, for example, the invention can be applied to a recording head such as various ink jet-type recording heads which are used in an image recording apparatus such as a printer, a color-material ejecting head that is used to manufacture a color filter such as a liquid crystal display, an electrode-material ejecting head that is used to produce an electrode, such as an organic EL display or a field emission display (FED), and a bio-organic material ejecting head that is used to manufacture a bio chip.

In addition, the wiring mounting structure and the method of manufacturing the wiring mounting structure in general are targets of the invention and thus the invention can be applied to another device in addition to the liquid ejecting head.

The entire disclosure of Japanese Patent Application No. 2014-028255, filed Feb. 18, 2014 is expressly incorporated by reference herein.

What is claimed is:

1. A wiring mounting structure comprising:

a first base that has a first main surface, a second main surface that is an undersurface opposite to the first main surface, and an inclined surface that is formed between the first main surface and the second main surface to have an angle as a reference angle with the second main surface, which is less than 90 degrees;

a second base that has a third main surface which is joined to the second main surface of the first base;

an adhesive which is disposed between the second main surface of the first base and the third main surface of the second base from an end portion of the inclined surface of the first base to an exposed region on the third main surface of the second base and by which the first base and the second base are joined; and a connection wiring that is provided to be continuous from the inclined surface to a front surface of the adhesive to the third main surface of the second base, wherein the connection wiring directly contacts the inclined surface, the front surface, and the third main surface, wherein the front surface of the adhesive is provided to be continuous to the inclined surface and thus an angle formed between the front surface of the adhesive in a portion in which the adhesive is provided to be continuous to the inclined surface and the third main surface on which the adhesive is provided is less than the reference angle, and wherein the adhesive provided to be continuous to the inclined surface is also provided on the inclined surface.

2. The wiring mounting structure according to claim 1, wherein, with respect to a straight line that connects a contact point between the front surface of the adhesive and the third main surface and a contact point between the front surface of the adhesive and the inclined surface, the front surface of the adhesive is provided on the side of the third main surface in which the straight line is included.

* * * * *